US006833346B1

(12) United States Patent
Morrison et al.

(10) Patent No.: US 6,833,346 B1
(45) Date of Patent: Dec. 21, 2004

(54) PROCESS FOR MAKING DETERGENT PARTICULATES

(75) Inventors: Christopher Andrew Morrison, Cullercoats (GB); Scott John Donoghue, Newcastle upon Tyne (GB); Graham Simpson, Gateshead (GB)

(73) Assignee: The Procter & Gamble Company, Cincinnati, OH (US)

( * ) Notice: Subject to any disclaimer, the term of this patent is extended or adjusted under 35 U.S.C. 154(b) by 262 days.

(21) Appl. No.: 09/979,529

(22) PCT Filed: Jun. 20, 2000

(86) PCT No.: PCT/US00/16916

§ 371 (c)(1),
(2), (4) Date: Nov. 14, 2001

(87) PCT Pub. No.: WO00/78908

PCT Pub. Date: Dec. 28, 2000

Related U.S. Application Data

(60) Provisional application No. 60/140,094, filed on Jun. 21, 1999.

(51) Int. Cl.[7] ..... C11D 11/00

(52) U.S. Cl. ..... 510/444; 510/101; 510/301

(58) Field of Search ..... 510/444, 101, 510/301, 220, 276

(56) References Cited

U.S. PATENT DOCUMENTS

| | | | | | |
|---|---|---|---|---|---|
| 3,714,051 | A | | 1/1973 | Milesi et al. | 510/530 |
| 4,462,804 | A | * | 7/1984 | Gangwisch et al. | 8/137 |
| 4,536,315 | A | * | 8/1985 | Ramachandran et al. | 510/349 |
| 4,605,506 | A | * | 8/1986 | Wixon | 510/328 |
| 4,699,729 | A | * | 10/1987 | Parr et al. | 510/334 |
| 4,818,421 | A | * | 4/1989 | Boris et al. | 510/297 |
| 5,188,753 | A | * | 2/1993 | Schmidt et al. | 510/395 |
| 5,376,288 | A | * | 12/1994 | Falholt et al. | 510/301 |
| 5,569,645 | A | * | 10/1996 | Dinniwell et al. | 510/276 |
| 5,648,328 | A | * | 7/1997 | Angell et al. | 510/441 |
| 5,691,303 | A | * | 11/1997 | Pan et al. | 512/4 |
| 5,705,466 | A | * | 1/1998 | Baillely et al. | 510/312 |
| 5,792,738 | A | * | 8/1998 | Baillely et al. | 510/375 |
| 6,069,124 | A | * | 5/2000 | Appel et al. | 510/438 |

FOREIGN PATENT DOCUMENTS

| | | | |
|---|---|---|---|
| DE | 42 43 704 | A1 | 6/1994 |
| EP | 0816485 | A1 * | 1/1998 |
| FR | 2 285 453 | | 4/1976 |
| GB | 2 120 695 | A | 4/1983 |
| GB | 2 190 921 | A | 12/1987 |
| WO | WO00/18875 | | 4/2000 |

* cited by examiner

*Primary Examiner*—Lorna M. Douyon
(74) *Attorney, Agent, or Firm*—Julia A. Glazer; Brahm J. Corstanje; Kim William Zerby

(57) ABSTRACT

Methods for making articulate detergents are disclosed. The detergent particulates are formed from a combination of pre-formed detergent particulates and other detergent ingredients may also be preformed such as blown powders, extrudates or agglomerates or particulate raw materials. Selection of the feed streams into a low or moderate shear mixing process enable of the finished detergent particle to be controlled without requiring careful control of the conditions.

6 Claims, No Drawings

PROCESS FOR MAKING DETERGENT PARTICULATES

This application is a 371 of PCT/US00/16916 filed Jun. 20, 2000 which claims the benefit of Provisional Application No. 60/140,094 filed Jun. 21, 1999.

FIELD OF THE INVENTION

The present invention relates to particulate detergent compositions and an improved process for making such compositions. The detergent compositions of the invention are suitable for any cleaning process, such as laundry and dishwashing detergent compositions. Such particulate compositions may be used directly in their particulate form or may first be formed into detergent tablets by any standard tabletting process such as compaction.

BACKGROUND OF THE INVENTION

In order to meet the needs of the consumer, in addition to providing good cleaning, detergent compositions must meet many additional requirements including good aesthetics, good flow properties, good solubility and good dispensing performance into wash water. In order to meet all of these requirements, the complexity of detergent compositions and range of products offered has grown. Formulation flexibility for producing such complex compositions is therefore extremely important and many methods for formulating detergent compositions are already known.

In view of the high performance requirements of the consumer, achieving uniform dosage of all of the detergent actives in the composition has increased importance, in particular where sophisticated detergent ingredients present in detergents at low levels make a significant impact on one of the performance features mentioned above. This problem is exacerbated by the advent of "compact" or low dosage granular detergent products. These low dosage detergents are currently in high demand as they conserve resources and can be sold is small packages which are more convenient for consumers prior to use. However, in a low dosage of detergent, where actives are present in very low levels, significant variability may occur in the concentration of such actives in each unit dosage. Performance problems have been identified with some compact detergent products and the present inventors have now found that this may be due to formulation variability where low level detergent ingredients which give a significant impact on one or more of the performance factors mentioned above may vary considerably from dose to dose.

SUMMARY OF THE INVENTION

The present invention therefore reduces these problems by providing a process in which such low dosage/high impact ingredients can be dispersed uniformly throughout a detergent formulation. Segregation is minimised without the need to incorporate high levels of fillers to form such low dosage/high impact ingredients into larger particles.

In accordance with the present invention there is now provided a method for making a detergent particles comprising selecting detergent base particles having a geometric mean particle diameter from 500–2000 microns, in a moderate to low shear mixer adhering detergent active particulates to the detergent base particles, wherein the detergent active particulates have a geometric mean particle diameter no greater than 40% of the geometric mean particle diameter of the detergent base particles and comprise a detergent active selected from perfumes, enzymes, photobleaches, catalysts, soil release polymers, suds suppressors, bleaching compounds, whitening agents and layered silicates.

The present invention also provides detergent particles produced by such a process, and detergent compositions incorporating these particles.

As used herein, it is intended to mean that a detergent active particulate is bound to the detergent base particulate, the two components subsequently appearing in a detergent composition as an individual detergent particle.

DETAILED DESCRIPTION OF THE INVENTION

Physical Properties

The detergent active particulates preferably have a geometric mean particle diameter which is below 200 $\mu$m, preferably below 150 $\mu$m and even below 100 $\mu$m. The geometric mean particle diameter of the detergent active particulates is generally above 10 $\mu$m preferably above 20 $\mu$m and may even be above 40 $\mu$m or above 60 $\mu$m.

As used herein, the phrase "geometric mean particle diameter" means the geometric mass median diameter of a set of discrete particles as measured by any standard mass-based particle size measurement technique, preferably by dry sieving. A suitable sieving method is in accordance with ISO 3118 (1976). A suitable device is the Ro-Tap testing sieve shaker Model B using 8 inch sieves of selected sizes. As used herein, the phrase "geometric standard deviation" or "span" of a particle size distribution means the geometric breadth of the best-fitted log-normal function to the above-mentioned particle size data which can be accomplished by the ratio of the diameter of the 84.13 percentile divided by the diameter of the $50^{th}$ percentile of the cumulative distribution ($D_{84.13}/D_{50}$); See Gotoh et al, *Powder Technology Handbook*, pp. 6–11, Marcel Dekker 1997.

The detergent base particles have a geometric mean particle diameter from 500 to 2000 $\mu$m. The geometric mean particle diameter of the detergent base particles is generally greater than 550 $\mu$m or even greater than 600 $\mu$m or 650 $\mu$m. Preferably, the geometric mean particle diameter of the detergent base particles is below 1500 $\mu$m.

The detergent particles produced preferably have a geometric standard deviation of from 1 to about 2, preferably from 1.0 to 1.7, more preferably from about 1.0 to about 1.4. Preferred fully formulated detergents comprising the detergent particles also have such a geometric standard deviation.

Preferably the geometric mean particle diameter of the detergent active particulates is no greater than 20% of the geometric mean particle diameter of the detergent base particles more preferably no greater than 10% and may even be below 5% of the geometric mean particle diameter of the detergent base particles. Generally in the detergent particles, no more than 25 wt. % is derived from the detergent active particulates, preferably no greater than 10 wt %. The invention may even be useful where the proportion of the detergent particles derived from the detergent active particulates is no greater than 5 or even no greater than 2 wt %.

As used herein the term "bulk density" refers to the uncompressed, untapped powder bulk density, as measured by pouring an excess of particulate sample through a funnel into a smooth metal vessel (e.g. a 500 ml volume cylinder) scraping off the excess off the heap above the rim of the vessel, measuring the remaining mass of powder and dividing the mass by the volume of the vessel.

The bulk density of the detergent particles produced and also of the detergent base particles is generally above 200 g/l and may be as high as 1500 g/l. It is particularly preferred that the bulk density a finished detergent composition comprising the detergent particles produced according to the present invention is greater than 550 g/l, preferably greater than 600 g/l or even above 650 g/l. The bulk density of the detergent particles produced is therefore generally from 400 g/l to 1100 g/l, generally above 500 g/l or even above 550 or 650 g/l, generally less than 1000 g/l or below 900 g/l. The invention may be particularly useful for forming detergent particles having a low bulk density such as below 550 or even below 500 or 450 g/l.

The detergent base particles for use in the method of the present invention may comprise a single detergent ingredient in particulate form or may be a pre-mix of detergent ingredients. Where the detergent base particles comprise a pre-mix, the separate detergent ingredients may simply be mixed together or may comprise a pro-formed particulate comprising any combination of two or more detergent ingredients, or mixtures thereof, optionally with single detergent ingredients. Suitable pre-formed particulates for the base particles may have been formed by spray-drying, agglomeration, marumerisation, extrusion or compaction, all of which methods for combining detergent ingredients are well-known in the art. Particularly preferred pre-formed particulates are powders obtained from spray-drying processes, agglomerates and extrudates. Spray-dried powders are particularly useful. Pre-formed particulates made according to at least one low shear mixing step, for example in a fluidized bed, for example by fluid bed agglomeration are particularly preferred. Particularly preferred particles are as described in our co-pending application filed today under reference number CM2158F. Procter & Gamble application Ser. No. 09/979,528, filed Jun. 20, 2001, now U.S. Pat. No. 6,579,844.

Suitable spray-dying processes for forming such pre-formed particulates are described for example in EP-A-763594 or EP-A437888. Suitable processes for forming pre-formed particulates which are agglomerates are described for example in WO93/25378, EP-A-367339, EP-A-420317 or EP-A-506184 and suitable processes for forming pre-formed particulates by extrusion are described for example in WO91/02047.

Such pre-formed particulates may be added to the mixer in their wet or dry state. They are preferably added to the mixer in their dry state as addition in their wet state may have an adverse effect on flow into the mixer. Alternatively it may be preferred that the pre-formed particulates are formed in a first stage of a moderate to low shear mixer and the detergent active particulates are added in a second stage so that the pre-formed particulates may be in a wet state when they are contacted with the detergent active particulates. Thus, the pre-formed particulate may be for example an agglomerate, blown powder or extrudate which has not yet undergone a final drying stage.

Generally this means that a solvent used as a binding agent for the processing is present in higher amounts than are desirably present in a finished particulate detergent. Generally the solvent is water and wet particulates will have a free water content for example of from 5 to 30 wt % of the pre-formed particulate. Often, however, the pre-formed particulate will already have undergone a drying step prior to addition to the mixer so that the water content will be below 15 wt %, preferably below 10 wt %. Generally the free water content of the detergent base particles on entry into the mixer will be below 15 wt %, preferably below 10 wt %.

It may be preferred that the detergent base particles comprise a surfactant or mixture of surfactants. Suitable surfactants are described below. The surfactant content of the detergent base particles or a pre-formed particulate component forming all or part of the detergent base particles is preferably from 5 to 80% by weight of the particulate component. Amounts of surfactants above 10 or even above 30% may be preferred. Amounts of surfactant below 70% or even below 50% may be preferred. Where the detergent base preformed particulate component comprises surfactant, generally it will in addition comprise a builder or alkalinity agent such as sodium carbonate, zeolite, or phosphate. For example, each of these components individually, or in mixtures may be present in amounts above 5%, preferably above 10% or even above 20% by weight of the content of the pre-formed particulate component. Particularly preferred builder components are sodium carbonate and/or zeolite. Zeolite A and zeolite MAP are both suitable.

The detergent base particles preferably also comprises an organic builder such as a poly carboxylic acid and/or salt such as citric acid, tartaric acid, malic acid, succinic acid and their salts or a polymeric polycarboxylate such as polymers based on acrylic acids or maleic acids or copolymers thereof. Such components are generally present in the particle at levels below 15 wt % of the particulate component, preferably below 10 wt % of the particulate component.

Other preferred ingredients in the pre-formed particulate component are chelants such as phosphonate chelants NTA, DTPA and succinic acid derivative chelants, as described below. These components are preferably present in the detergent base particles in amounts below 5 wt % or even below 2 wt %. Suds supressors and/or soil release polymers and/or bleach activators are also preferred ingredients in pre-formed particulates.

Where the particulate components are detergent raw materials, any particulate detergent ingredient is suitable. These may be solid surfactants or soaps, or water soluble or dispersable polymeric materials, enzymes, bleaching components such as bleach activators or bleach salts such as peroxy salts. Highly suitable single ingredients in particulate form include inorganic components, particularly water-soluble inorganic components such as builders and bleach salts such as alkali metal percarbonates and/or perborates. These ingredients are discussed in more detail below.

Suitable detergent ingredients for incorporation either into the detergent particles themselves, or for post-addition to formulate a fully formulated detergent composition are discussed below.

The detergent active particulates are selected from perfumes, enzymes, photobleaches, catalysts, soil release polymers, suds suppressors, bleaching compounds, whitening agents and layered silicates.

Perfumes

Preferred detergent active particulates comprise perfume. Any perfume or perfume composition can be used. However, it must be solid or in combination with other components so that it has a solid form. For example it may be loaded onto a particulate carrier such as zeolite, or any other known solid carrier, for example as described in WO94/16046, ES93000006. EP-A-535942, and EP-A-294206. More preferably it is present in encapsulated form. Suitable encapsulates are described for example in WO94/12613, EP-A-539025, EP-A-478326, EP-A-383406, EP-A-382464, EP-A-346034, EP-A-70719. Particularly preferred encapsulates comprise starch.

Preferred perfumes contain at least one component with a low molecular weight volatile component, e.g. having a molecular weight of from 150 to 450 or preferably 350. Preferably, the perfume component comprises an oxygen-containing functional group. Preferred functional groups are aldehyde, ketone, alcohol or ether functional groups or mixtures thereof.

Enzymes

The detergent active particulates may comprise one or more enzymes. Suitable enzymes include the commercially available lipases, cutinases, amylases, neutral and alkaline proteases, cellulases, endolases, esterases, pectinases, lactases and peroxidases conventionally incorporated into detergent compositions. Suitable enzymes are discussed in U.S. Pat. Nos. 3,519,570 and 3,533,139.

Preferred commercially available protease enzymes include those sold under the tradenames Alcalase, Savinase, Primase, Durazym, and Esperase by Novo Industries A/S (Denmark), those sold under the tradename Maxatase, Maxacal and Maxapem by Gist-Brocades, those sold by Genencor International, and those sold under the tradename Opticlean and Optimase by Solvay Enzymes. Protease enzyme may be incorporated into the compositions in accordance with the invention at a level of from 0.0001% to 4% active enzyme by weight of the composition.

Preferred amylases include, for example, α-amylases, described in more detail in GB-1,269,839 (Novo). Preferred commercially available amylases include for example, those sold under the trade name Rapidase by Gist-Brocades, and those sold under the trade name Termamyl, Duramyl and BAN by Novo Industries A/S. Preferred amylase enzymes may be those described in PCT/US 9703635 published Sep. 12, 1997, and in WO95/26397 and WO96/23873. Amylase enzyme may be incorporated into the composition in accordance with the invention at a level of from 0.0001% to 2% active enzyme by weight.

Lipolytic enzyme maybe present at levels of active lipolytic enzyme of from 0.0001% to 2% by weight, preferably 0.001% to 1% by weight, most preferably from 0.001% to 0.5% by weight based on the content in the final detergent composition. The lipase may be fungal or bacterial in origin being obtained, for example, from a lipase producing strain of *Humicola* sp., *Thermomyces* sp. or *Pseudomonas* sp. including *Pseudomonas pseudoalcaligenes* or *Pseudomas fluorescens*. Lipase from chemically or genetically modified mutants of these strains are also useful herein. A preferred lipase is derived from *Pseudomonas pseudoalcaligenes*, which is described in EP-B-0218272. Another preferred lipase is obtained by cloning the gene from *Humicola lanuginosa* and expressing the gene in *Aspergillus orvza* as host, as described in European Patent Application, EP-A-0258 068, which is commercially available from Novo Industri A/S, Bagsvaerd, Denmark, under the trade name Lipolase. This lipase is also described in U.S. Pat. No. 4,810,414, Huge-Jensen et al, issued Mar. 7, 1989.

Photobleaches

Preferred detergent active particulates comprise photobleach particles. Preferred photo-bleaches herein comprise a compounds having a porphin or porphyrin structure. Porphin and porphyrin, in the literature, are used as synonyms, but conventionally porphin stands for the simplest porphyrin without any substituents; wherein porphyrin is a sub-class of porphin. The references to porphin in this application will include porphyrin. The porphin structures preferably comprise a metal element or cation, preferably Ca, Mg, P, Ti, Cr, Zr, In, Sn or Hf, more preferably Ge, Si or Ga, or more preferably Al, most preferably Zn. It can be preferred that the photo-bleach or component is substituted with substituents selected from alkyl groups such as methyl, ethyl, propyl, t-butyl group and aromatic ring systems such as pyridyl, pyridyl-N-oxide, phenyl, naphthyl and anthracyl moieties.

The photo-bleaching compound or component can have solubilizing groups as substituents. Alternatively, or in addition hereto the photo-bleaching agent can comprise a polymeric component capable of solubilizing the photobleaching compound, for example PVP, PVNP, PVI or co-polymers thereof or mixtures thereof.

Highly preferred photo-bleaching compounds have a phthalocyanine structure, which preferably have the metal elements or cations described above. The phthalocyanines can be substituted, suitable examples include the phthalocyanine structures which are substituted at one or more of the 14, 6, 8–11, 13, 15–18, 20, 22–25, 27 atom positions.

One preferred group of photobleaches comprise a polymeric component and a photobleaching component integrated with one another, whereby the weight ratio of polymeric component to photobleaching component is from 1:1 to 1000:1, preferably 20:1 to 100:1. Particularly preferred polymeric compounds are formed from monomeric units selected from N-vinylpyrolidone, N-vinylacetamide, N-vinyl imidazole, N-vinyl oxazolidone, N-vinyltriazole, 4-vinylpyridine and 4-vinylpyrilidine-N-oxide. Preferred photo-bleaching compounds are metals, preferably zinc, phthalocyamines or aluminium. Such photo-bleaches are described in GB 2329397A.

Soil Release Polymers

Preferred soil release polymers (SRPs) typically have hydrophilic segments to hydrophilize the surface of hydrophobic fibers such as polyester and nylon, and hydrophobic segments to deposit upon hydrophobic fibers and remain adhered thereto through completion of washing and rinsing cycles, thereby serving as an anchor for the hydrophilic segments. This can enable stains occurring subsequent to treatment with the SRP to be more easily cleaned in later washing procedures. Preferred SRPs include oligomeric terephthalate esters, typically prepared by processes involving at least one transesterification/oligomerization, often with a metal catalyst such as a titanium(IV) alkoxide. Such esters may be made using additional monomers capable of being incorporated into the ester structure through one, two, three, four or more positions, without, of course, forming a densely crosslinked overall structure.

Suitable SRPs include a sulfonated product of a substantially linear ester oligomer comprised of an oligomeric ester backbone of terephthaloyl and oxyalkyleneoxy repeat units and allyl-derived sulfonated terminal moieties covalently attached to the backbone, for example as described in U.S. Pat. No. 4,968,451, Nov. 6, 1990 to J. J. Scheibel and E. P. Gosselink. Such ester oligomers can be prepared by: (a) ethoxylating allyl alcohol; (b) reacting the product of (a) with dimethyl terephthalate ("DMT") and 1,2-propylene glycol ("PG") in a two-stage transesterification/oligomerization procedure; and (c) reacting the product of (b) with sodium metabisulfite in water. Other SRPs include the nonionic end-capped 1,2-propylene/polyoxyethylene terephthalate polyesters of U.S. Pat. No. 4,711,730. Dec. 8, 1987 to Gosselink et al., for example those produced by transesterification/oligomerization of poly-(ethyleneglycol) methyl ether, DMT, PG and poly(ethyleneglycol) ("PEG").

Other examples of SRA's include: the partly- and fully-anionic-end-capped oligomeric esters of U.S. Pat. No. 4,721,580, Jan. 26, 1988 to Gosselink, such as oligomers from ethylene glycol ("EG"), PG, DMT and Na-3,6-dioxa-8-hydroxyoctanesulfonate; the nonionic-capped block polyester oligomeric compounds of U.S. Pat. No. 4,702,857. Oct. 27, 1987 to Gosselink, for example produced from DMT, methyl (Me)-capped PEG and EG and/or PG, or a combination of DMT, EG and/or PG, Me-capped PEG and Na-dimethyl-5-sulfoisophthalate; and the anionic, especially sulfoaroyl, end-capped terephthalate esters of U.S. Pat. No. 4,877,896, Oct. 31, 1989 to Maldonado, Gosselink et al., the latter being typical of SRPs useful in both laundry and fabric conditioning products, an example being an ester composition made from m-sulfobenzoic acid monosodium salt, PG and DMT, optionally but preferably further comprising added PEG, e.g., PEG 3400. SRPs also include: simple copolymeric blocks of ethylene terephthalate or propylene terephthalate with polyethylene oxide or polypropylene oxide terephthalate, see U.S. Pat. No. 3,959,230 to Hays, May 25, 1976 and U.S. Pat. No. 3,893,929 to Basadur, Jul. 8, 1975; cellulosic derivatives such as the hydroxyether cellulosic polymers available as METHOCEL from Dow: the $C_1$–$C_4$ alkyl celluloses and $C_4$ hydroxyalkyl celluloses, see U.S. Pat. No. 4,000,093, Dec. 28, 1976 to Nicol, et al.; and the methyl cellulose ethers having an average degree of substitution (methyl) per anhydroglucose unit from about 1.6 to about 2.3 and a solution viscosity of from about 80 to about 120 centipoise measured at 20° C. as a 2% aqueous solution. Such materials are available as METOLOSE SM100™ and METOLOSE SM200™, which are methyl cellulose ethers manufactured by Shin-etsu Kagaku Kogyo KK.

Additional classes of SRPs include those described in U.S. Pat. No. 4,201,824, Violland et al. and U.S. Pat. No. 4,240,918 Lagasse et al.: and SRA's with carboxylate terminal groups made by adding trimellitic anhydride to known SRP's to convert terminal hydroxyl groups to trimellitate esters. With the proper selection of catalyst, the trimellitic anhydride forms linkages to the terminals of the polymer through an ester of the isolated carboxylic acid of trimellitic anhydride rather than b) opening of the anhydride linkage. Either nonionic or anionic SRPs may be used as starting materials as long as they have hydroxyl terminal groups which may be esterified. See U.S. Pat. No. 4,525,524 Tung et al., and U.S. Pat. No. 4,201,824, Violland et al.

Suitable soil release polymers may be selected from: (a) alkyl and hydroxyalkyl ethers of cellulose containing from one to four carbon atoms in the alkyl moiety and having a molar degree of substitution of from 1.5 to 2.7 and a number average molecular weight of from 2000 to 100000; (b) polymers comprising ethylene terephthalate and polyethylene oxide terephthalate at a mole ratio of from 1:10; (c) polymers comprising propylene terephthalate and polyethylene oxide terephthalate at a mole ratio of from 1:10 to 10:1, said polyethylene oxide terephthalate containing polyethylene oxide units with a number average molecular weight of from 500 to 10000 and said soil release agent having a number average molecular weight of from 1000 to 100000: and (d) polymers comprising ethylene terephthalate and/or propylene terephthalate in any ratio and polyethylene oxide and/or polypropylene oxide in any ratio such that the mole ratio of ethylene terephthalate plus propylene terephthalate to polyethylene oxide plus polypropylene oxide is from 1:10 to 10:1, said polyethylene oxide units and said polypropylene oxide units each having a number average molecular weight of from 250 to 10000 and said soil release agent having a number average molecular weight of from 1000 to 100000; and mixtures thereof; as described in more detail in EP-A-271312.

Suds Suppressors

The detergent active particulates may comprise suds supressors. Suitable suds suppressing systems may comprise essentially any known antifoam compound, including, for example silicone antifoam compounds and 2-alkyl alcanol antifoam compounds or soap.

By antifoam compound it is meant herein any compound or mixtures of compounds which act such as to depress the foaming or sudsing produced by a solution of a detergent composition, particularly in the presence of agitation of that solution.

Particularly preferred antifoam compounds for use herein are silicone antifoam compounds defined herein as any antifoam compound including a silicone component. Such silicone antifoam compounds also typically contain a silica component. The term "silicone" as used herein, and in general throughout the industry, encompasses a variety of relatively high molecular weight polymers containing siloxane units and hydrocarbyl group of various types. Preferred silicone antifoam compounds are the siloxanes, particularly the polydimethylsiloxanes having trimethylsilyl end blocking units.

Other suitable antifoam compounds include the monocarboxylic fatty acids and soluble salts thereof as described in U.S. Pat. No. 2,954,347, issued Sep. 27, 1960 to Wayne St. John. The monocarboxylic fatty acids, and salts thereof, for use as suds suppressor typically have hydrocarbyl chains of 10 to 24 carbon atoms, preferably 12 to 18 carbon atoms. Suitable salts include the alkali metal salts such as sodium, potassium, and lithium salts, and ammonium and alkanolammonium salts.

Other suitable antifoam compounds include, for example, high molecular weight fatty esters (e.g. fatty acid triglycerides), fatty acid esters of monovalent alcohols, aliphatic $C_{18}$–$C_{40}$ ketones (e.g. stearone) N-alkylated amino triazines such as tri- to hexa-alkylmelamines or di- to tetra alkyldiamine chlortriazines formed as products of cyanuric chloride with two or three moles of a primary or secondary amine containing 1 to 24 carbon atoms, propylene oxide, bis stearic acid amide and monostearyl di-alkali metal (e.g. sodium, potassium, lithium) phosphates and phosphate esters. A preferred suds suppressing system comprises:

(a) antifoam compound, preferably silicone antifoam compound, most preferably a silicone antifoam compound comprising in combination polydimethyl siloxane, at a level of from 50% to 99%, preferably 75% to 95% by weight of the silicone antifoam compound; and silica, at a level of from 1% to 50%, preferably 5% to 25% by weight of the silicone/silica antifoam compound;

wherein said silica/silicone antifoam compound is incorporated at a level of from 5% to 50%, preferably 10% to 40% by weight;

(b) a dispersant compound, most preferably comprising a silicone glycol rake copolymer with a polyoxyalkylene content of 72–78% and an ethylene oxide to propylene oxide ratio of from 1:0.9 to 1:1.1, at a level of from 0.5% to 10%, such as DCO544, commercially available from Dow Corning; and (c) an inert carrier fluid compound, most preferably comprising a $C_{16}$–$C_{18}$ ethoxylated alcohol with a degree of ethoxylation of from 5 to 50, preferably 8 to 15, at a level of from 5% to 80%, preferably 16% to 70%, by weight;

A highly preferred particulate suds suppressing system is described in EP-A-0210731 and comprises a silicone antifoam compound and an organic carrier material having a melting point in the range 50° C. to 85° C., wherein the organic carrier material comprises a monoester of glycerol and a fatty acid having a carbon chain containing from 12 to 20 carbon atoms. EP-A-0210721 discloses other preferred particulate suds suppressing systems wherein the organic carrier material is a fatty acid or alcohol having a carbon chain containing from 12 to 20 carbon atoms, or a mixture thereof, with a melting point of from 45° C. to 80° C.

Other highly preferred suds suppressing systems comprise polydimethylsiloxane or mixtures of silicone, such as polydimethylsiloxane, aluminosilicate and polycarboxylic polymers, such as copolymers of laic and acrylic acid.

Bleaching Compounds

The detergent active particulates may comprise one or more bleaching compounds. Suitable bleaching compounds include bleach activators, preformed peracids and peracid salts such as alkali metal percarbonate and/or perborate. The chemical nature of these components is discussed in more detail below in the section entitled "Detergent Ingredients". Preferred bleach compounds are bleach activators such as TAED, NOBS, ISONOBS etc, as discussed below, and the persalts such as alkali metal percarbonate and/or perborate. Sodium salts are particularly preferred.

Whitening Agents

Suitable whitening agents include hydrophilic optical brighteners such as include those having the structural formula:

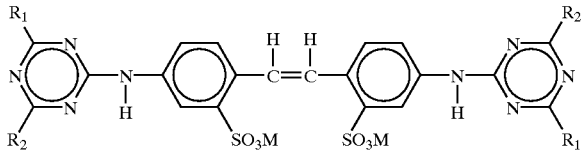

wherein $R_1$ is selected from anilino, N-2-bis-hydroxyethyl and NH-2-hydroxyethyl; $R_2$ is selected from N-2-bis-hydroxyethyl, N-2-hydroxyethyl-N-methylamino, morphilino, chloro and amino; and M is a salt-forming cation such as sodium or potassium.

When in the above formula, $R_1$ is anilino, $R_2$ is N-2-bis-hydroxyethyl and M is a cation such as sodium, the brightener is 4,4',-bis[(4-anilino-6(N-2-bis-hydroxyethyl)-s-triazine-2-yl)amino]-2,2'-stilbenedisulfonic acid and disodium salt. This particular brightener species is commercially marketed under the tradename Tinopal-UNPA-GX by Ciba-Geigy Corporation. Tinopal-CBS-X and Tinopal-UNPA-GX is the preferred hydrophilic optical brightener useful in the detergent compositions herein.

When in the above formula, $R_1$ is anilino, $R_2$ is N-2-hydroxyethyl-N-2-methylamino and M is a cation such as sodium, the brightener is 4,4'-bis[(4-anilino-6-(N-2-hydroxyethyl-N-methylamino)-s-triazine-2-yl)amino]2,2'-stilbenedisulfonic acid disodium salt. This particular brightener species is marketed as Tinopal 5BM-GX™ by Ciba-Geigy Corporation.

When in the above formula, $R_1$ is anilino, $R_2$ is morphilino and M is a cation such as sodium, the brightener is 4,4'-bis[(4-anilino-6-morphilino-s-triazine-2-yl)amino]2,2'-stilbenedisulfonic acid, sodium salt. This particular brightener species are sold by Ciba Geigy Corporation as Tinopal-DMS-X™ and Tinopal AMS-GX™.

Layered Silicates

Suitable crystalline layered silicates are described for example in U.S. Pat. No. 4,664,839. Crystalline layered silicates rich in delta-phase are preferred, such as those described in WO97/19156.

Catalysts

The detergent active particulates may also comprise catalyst particulates. Suitable catalysts include transition metal-containing bleach catalyst. One suitable type of bleach catalyst is a catalyst system comprising a heavy metal cation of defined bleach catalytic activity, such as copper, iron or manganese cations, an auxiliary metal cation having little or no bleach catalytic activity, such as zinc or aluminium cations, and a sequestrant/chelant having defined stability constants for the catalytic and auxiliary metal cations, particularly ethylenediamine tetraacetic acid, ethylenediamine tetra(methylenephosphonic acid) and water-soluble salts thereof. Such catalysts are disclosed in U.S. Pat. No. 4,430,243.

Other types of bleach catalysts include the manganese-based complexes disclosed in U.S. Pat. No. 5,246,621 and U.S. Pat. No. 5,244,594. Preferred examples of these catalysts include MnIV2(u-O)3(1,4,7-trimethyl-1,4,7-triazacyclononane)2-(PF6)2, MnIII2(u-O)1(u-Oac)2(1,4,7-trimethul-1,4,7-triazacyclononane)2-(ClO4)2, MnIV4(u-O)6(1,4,7-triaxacyclononane)4(ClO4)2, MnIIIMnIV4(u-O)1(u-Oac)2-(1,4,7-trimethyl-1,4,7-triazacyclononane)2-(ClO4)3, and mixtures thereof. Others are described in EP-A-549272. Other suitable ligands include 1,5,9-trimethyl-1,5,9-triazacyclododecane, 2-methyl-1,4,7-triazacyclononane, 2-methyl-1,4,7-triazacyclonanone, 1,2,4,7-tetramethyl-1,4,7-triazacyclononane, and mixtures thereof.

For examples of suitable bleach catalysts see U.S. Pat. No. 4,246,612 and U.S. Pat. No. 5,227,084. See also U.S. Pat. No. 5,194,416 which teaches nononuclear manganese (IV) complexes such as Mn(1,4,7-trimethyl-1,4,7-triazacyclonanone)(OCH3)3-(PF6). Still another type of bleach catalyst as disclosed in U.S. Pat. No. 5,114,606 is a water-soluble complex of manganese (III) and/or (IV) with a ligand which is a non-carboxylate polyhydroxy compound having at least three consecutive C—OH groups. Other examples include binuclear Mn complexed with tetra-N-dentate and bi-N-dentate ligands, including N4MnIII(u-O)2MnIVN4)+ and [Bipy2MnIII(u-O)2MnIVbipy2]-(ClO4)3.

Further suitable bleach catalysts are described for example in EP 408131 (cobalt complex catalysts) EP 384503 and 306089 (metallo-porphyrin catalysts) U.S. Pat. No. 4,728,455 (manganese/multidentate ligand catalyst) U.S. Pat. No. 4,711,748 and EP 224952 (absorbed manganese on aluminosilicate catalyst) U.S. Pat. No. 4,601,845 (aluminosilicate support with manganese and zinc or magnesium salt) U.S. Pat. No. 4,626,373 (manganese/ligand catalyst), U.S. Pat. No. 4,119,557 (ferric complex catalyst), German Patent specification 2054019 (cobalt chelant catalyst), Canadian 866191 (transition metal-containing salts), U.S. Pat. No. 4,430,243 (chelants with manganese cations and non-catalytic metal cations), and U.S. Pat. No. 4,728,455 (manganese gluconate catalysts).

The preferred detergent active particulates comprise perfume, photobleach and/or catalyst. Perfume and/or photobleaches are particularly preferred. In a particularly preferred aspect of the invention, the detergent active particulates comprise encapsulated perfume. In a further particularly preferred aspect of the invention, the detergent active particulates comprise photobleach.

The preferred proportion of detergent active particulates to detergent base powder will vary dependent upon the relative particle sizes of these two components. Preferably in the final detergent composition the weight percentage of any one of the detergent active particulates will be no greater than 10 wt %, preferably below 5 wt % or even below 2 or 1% of the detergent base particles. In particular where the proportion of detergent active particulates is as low as 5 or 2 or 1% wt % of the detergent base powder, preferably the geometric mean particle size of the detergent active particulates is no greater than 20%, preferably no greater than 10% or even below 5 or even 2 or 1% of the geometric mean particle size of the detergent base particles.

The detergent particles themselves may contain all of the ingredients of a full formulated detergent or may be mixed with additional detergent components such as individual detergent ingredients in particulate form or pre-formed detergent particles as described above which may form part of the detergent base particles. The individual detergent ingredients in particulate form may be any of the detergent ingredients described below, in a particulate form. Preferably, detergent compositions of the present invention comprise more than 30 wt %, more preferably more than 50 wt % or even as high as 80 or 90 wt % or even 95 wt % of the detergent particles according to the present invention. The higher the level of detergent particles of the present invention, the greater the benefits of the invention in terms of promoting uniform dosages of detergent from a package of particulate detergent or in a unit dosage which is formed into a tablet.

The processes of the invention may comprise the step of adding to the mixer a binder to facilitate production of the desired detergent particles. Generally such a binder will be liquid in the form of a solution or melt and will be added by spraying either directly into the mixer or onto the particulate components as they travel into the mixer. Preferably the binder is added directly into the mixer for example by spraying. The binder is added for purposes of enhancing agglomeration by providing a binding or sticking agent for detergent components. The binder may be any conventional detergent binding agent, preferably selected from the group consisting of water, anionic surfactants, nonionic surfactants, polyethylene glycol, polyvinyl pyrrolidone, polyacrylates, organic acids or their salts such as citric acid or citric salts, and mixtures thereof. Other suitable binder materials including those listed herein are described in Beerse et al, U.S. Pat. No. 5,108,646 (Procter and Gamble Company), the disclosure of which is incorporated herein by reference. The binder must be compatible with the detergent active particulate as will be appreciated by persons skilled in the art. Thus, where the stability of the detergent active particulate is adversely affected by water, the binder will be substantially water-free.

Thus, in one aspect of the invention, a first feed stream of detergent base powder is fed into the mixer and in addition a second feed stream comprising a detergent active particulates is fed into the mixer and binder is also present in the mixer. The binder may be fed directly via a third stream into the mixer or it may be contacted with the detergent base particles or detergent active particulates prior to one or both of these feed streams entering the mixer, for example the detergent active particulate (or a proportion of the base particles) may be entrained in the binder. Where the mixer is divided into different zones, the three components may be fed into the same zone or optionally may be fed into different zones. In a preferred embodiment of the invention, the detergent base particles and detergent active particulates will be pre-mixed prior to addition of the binder.

In a further preferred aspect of the invention, after mixing of the detergent base particles and detergent active particulates, so that adhesion of the two components has taken place, a further liquid component is applied to the outside of the particles produced. This further coating may be the same chemical composition as the binder or may be any of the other coating materials or detergent ingredients described below.

The moderate to low shear mixer to be used in the present invention may be for example a Lodige KM (trademark) (Ploughshare) moderate speed mixer, or mixer made by Fukae, Draes, Schugi or similar brand mixers which mix with only moderate to low shear. The Lodige KM (ploughshare) moderate speed mixer which is a preferred mixer for use in the present invention comprises a horizontal hollow static cylinder having a centrally mounted rotating shaft around which several plough-shaped blades are attached. Preferably, the shaft rotates at a speed of from about 15 rpm to about 140 rpm, more preferably from about 80 rpm to about 120 rpm. The grinding or pulverizing is accomplished by cutters, generally smaller in size than the rotating shaft, which preferably operate at about 3600 rpm. Other mixers similar in nature which are suitable for use in the process include the Lodige Ploughshare™ mixer and the Drais® K-T 160 mixer. Generally, in the processes of the present invention, the shear will be no greater than the shear produced by a Lodige KM mixer with the tip speed of the ploughs below 10 m/s, or even below 8 m/s or even lower.

Preferably, the mean residence time of the various starting detergent ingredients in the low or moderate speed mixer is preferably in range from about 0.1 minutes to about 30 minutes, most preferably the residence time is about 0.5 to about 5 minutes. In this way, the density of the resulting detergent agglomerates is at the desired level.

Other suitable mixers for use in the present invention are low or very low shear mixers such as rotating bowl agglomerators, drum agglomerators, pan agglomerators and fluid bed agglomerators.

Fluid bed agglomerators are particularly preferred. Typical fluidised bed agglomerators are operated at a superficial air velocity of from 0.1 to 4 ml/s, either under positive or negative pressure. Inlet air temperatures generally range from −10 or 5° C. up to 250° C. However inlet air temperatures are generally below 200° C., or even below 150° C. The fluidized bed granulator is preferably operated such that the flux number FN of the fluid bed is at least about 2.5 to about 4.5. Flux number ($FN_m$) is a ratio of the excess velocity ($U_c$) of the fluidisation gas and the particle density ($p_p$) relative to the mass flux ($q_{liq}$) of the liquid sprayed into the bed at a normalized distance ($D_o$) of the spraying device. The flux number provides an estimation of the operating parameters of a fluidized bed to control granulation within the bed. The flux number may be expressed either as the mass flux as determined by the following formula:

$$FN_m = \log_{10}[\{P_p U_c\}/q_{liq}]$$

or as the volume flux as determined by the formula:

$$FN_v = \log_{10}[\{U_c\}/q_{vliq}]$$

where $q_{vliq}$ is the volume of spray into the fluid bed. Calculation of the flux number and a description of its usefulness is fully described in WO 98/58046 the disclosure of which is herein incorporated by reference.

In addition, the fluidized bed is generally operated at a Stokes number of less than about 1, more preferably from about 0.1 to about 0.5. The Stokes number is a measure of particle coalescence for describing the degree of mixing occurring to particles in a piece of equipment such as the fluid bed. The Stokes number is measured by the formula:

$$\text{Stokes number}=4pvd/9u$$

wherein p is the apparent particle density, v is the excess velocity, d is the mean particle diameter and u is the viscosity of the binder. The Stokes number and a description of its usefulness is described in detail in WO 99/03964, the disclosure of which is herein incorporated by reference.

Thus, where the mixer is a fluid bed mixer, detergent base particles of the present invention are passed into a fluid bed optionally hawing multiple internal "stages" or "zones". A stage or zone is any discrete area within the fluid bed, and these terms are used interchangeably herein. The process conditions within a stage may be different or similar to the other stages in the fluid bed/driver. It is understood that two adjacent fluid beds are equivalent to a single fluid bed having multiple stages. The various feed streams of detergent base particles and detergent active particulates can be added either at the same or at the different stages, depending on, for example, the particle size and moisture level of the feed stream. Feeding different streams to different stages can minimize the heat load on the fluid bed, and optimize the particle size and increase uniformity of the shape of the detergent particles produced.

The bed is typically fluidized with heated air in order to dry or partially dry moisture such as the binder liquids from the ingredients in the fluid bed. Where binder is sprayed into the fluid bed the spraying is generally achieved via nozzles capable of delivering a fine or atomized spray of the binder to achieve intimate nixing with the particulates. Typically, the droplet size from the atomizer is less than about 2 times the particle size. This atomization can be achieved either through a conventional two-fluid nozzle with atomizing air, or alternatively by means of a conventional pressure nozzle. To achieve this type of atomization, the solution or slurry rheology is may have a viscosity of less than about 500 centipoise, preferably less than about 200 centipoise at the point of atomization. While the nozzle location in the fluid bed may be in most any location, the preferred location is a positioning that allows a vertical down spray of any liquid components such as binder. This may be achieved for example, using a top spray configuration. To achieve best results, the nozzle location is placed at or above the fluidized height of the particles in the fluid bed. The fluidized height is typically determined by a weir or overflow gate height. The agglomeration/granulation zone of the fluid bed may be followed by an optional coating zone, followed by a drying zone and a cooling zone. Of course, one of ordinary skill in the art will recognize that alternative arrangements are also possible to achieve the resultant particles of the present invention.

Typical conditions within a fluid bed apparatus of the present invention include: (i) a mean residence time from about 1 to about 20 minutes, (ii) a depth of unfluidised bed of from about 100 to about 600 mm, (iii) a droplet spray size of less than 2 times the mean particle size in the bed, which is preferably not more than about 100 micron more preferably not more than 50 microns, (iv) spray height generally from 150 to 1600 nun of spray height from the fluid bed plate or preferably 0 to 600 mm from the top of the fluid bed, (v) from about 0.1 to about 4.0 m/s, preferably 1.0 to 3.0 m/s of fluidizing velocity and (vi) from about 12 to about 200° C. of bed temperature, preferably 15 to 100° C. Once again, one of ordinary skill in the art will recognise that the conditions in the fluid bed may vary depending on a number of factors.

The detergent particles produced in the mixer can be further processed by adding a coating agent to improve the particle colour, increase the particle % whiteness or improve the particle flowability after the detergent particles exit the mixer or the dryer if an optional drying step is added subsequently to the mixer or in a later stage in the mixer, to obtain the high density granular detergent compositions produced by the processes of the invention. Those skilled in the art will appreciate that a wide variety of methods may be used to dry as well as cool the exiting detergent without departing from the scope of the invention. Since the mixer can be operated at relatively low temperatures, the need for cooling apparatus is generally not required in the present process which thereby further reduces manufacturing costs of the final product.

Another optional processing step includes continuously adding a coating agent such as zeolite and/or fumed silica to the mixer to facilitate free flowability of the resulting detergent particles and to prevent over agglomeration. Such coating agents generally have a mean particle size below 100 microns, preferably below 60 microns, even more preferably below 50 microns.

Any coating stage may take place either immediately after formation of the detergent particles of the invention either before or after any drying step and optionally after the detergent particles have been mixed with additional detergent ingredients for forming a fully formulated detergent composition. Preferably any such coating agent will also have detergent active properties. A particularly preferred coating agent is a surfactant or aqueous solution of surfactant.

Detergent ingredients which are suitable as ingredients of the base powder, and/or as ingredients of the detergent active particulates and/or as ingredients of any additional ingredients added to the detergent particles of the present invention to form the fully formulated detergent compositions of the invention are described below.

Detergent Ingredients

Surfactant

Suitable surfactants for use in the invention are anionic, nonionic, ampholytic, and zwitterionic classes of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch). A list of suitable cationic surfactants is given in U.S. Pat. No. 4,259,217 issued to Murphy on Mar. 31, 1981.

Preferably, the detergent particle of the present invention and compositions comprising such particles comprises an additional anionic surfactant. Essentially any anionic surfactants useful for detersive purposes can be comprised in the detergent composition. These can include salts (including, for example, sodium, potassium, ammonium, and substituted ammonium salts such as mono-, di- and triethanolamine salts) of the anionic sulfate, sulfonate, carboxylate and sarcosinate surfactants. Anionic sulfate and sulfonate surfactants are preferred.

The anionic surfactants may be present in the detergent particle in amounts below 25 wt % or even below 20 wt % but in a final detergent composition comprising the particle, is preferably present at a level of from 0.1% to 60%, more preferably from 1 to 40%, most preferably from 5% to 30% by weight.

Other anionic surfactants include the anionic carboxylate surfactants such as alkyl ethoxy carboxylates, alkyl polyethoxy polycarboxylates and soaps ("alkyl carboxyls") such as water-soluble members selected from the group consisting of the water-soluble salts of 2-methyl-1-undecanoic acid, 2-ethyl-1-decanoic acid, 2-propyl-1-nonanoic acid. 2-butyl-1-octanoic acid and 2-pentyl-1-heptanoic acid. Certain soaps may also be included as suds suppressors. Other suitable anionic surfactants are the alkali metal sarcosinates of formula R-CON($R^1$) $CH_2$ COOM, wherein R is a $C_5$–$C_{17}$ linear or branched alkyl or alkenyl group, $R^1$ is a $C_1$–$C_4$ alkyl group and M is an alkali metal ion. Other anionic surfactants include isethionates such as the acyl isethionates, N-acyl taurates, fatty acid amides of methyl tauride, alkyl succinates and sulfosuccinates monoesters of sulfosuccinate (especially saturated and unsaturated $C_{12}$–$C_{18}$ monoesters) diesters of sulfosuccinate (especially saturated and unsaturated $C_6$–$C_{14}$ diesters), N-acyl sarcosinates. Resin acids and hydrogenated resin acids are also suitable, such as rosin, hydrogenated rosin, and resin acids and hydrogenated resin acids present in or derived from tallow oil.

Anionic sulfate surfactants suitable for use herein include the linear and branched primary and secondary alkyl sulfates, alkyl ethoxysulfates, fatty oleoyl glycerol sulfates, alkyl phenol ethylene oxide ether sulfates, the $C_5$–$C_{17}$ acyl-N-($C_1$–$C_4$ alkyl) and —N-($C_1$–$C_2$ hydroxyalkyl) glucamine sulfates, and sulfates of alkylpolysaccharides such as the sulfates of alkylpolyglucoside (the nonionic nonsulfated compounds being described herein). Alkyl sulfate surfactants are preferably selected from the linear and branched primary $C_{10}$–$C_{18}$ alkyl sulfates, more preferably the $C_{11}$—$C_{15}$ branched chain alkyl sulfates and the $C_{12}$–$C_{14}$ linear chain alkyl sulfates. Alkyl ethoxysulfate surfactants are preferably selected from the group consisting of the $C_{10}$–$C_{18}$alkyl sulfates which have been ethoxylated with from 0.5 to 20 moles of ethylene oxide per molecule. More preferably, the alkyl ethoxysulfate surfactant is a $C_{11}$–$C_{18}$ most preferably $C_{11}$–$C_{15}$ allyl sulfate which has been ethoxylated with from 0.5 to 7, preferably from 1 to 5, moles of ethylene oxide per molecule.

Preferred surfactant combinations are mixtures of the preferred alkyl sulfate and/or sulfonate and alkyl ethoxysulfate surfactants optionally with cationic surfactant. Such mixtures have been disclosed in PCT Patent Application No. WO 93/18124.

Anionic sulfonate surfactants suitable for use herein include the salts of $C_5$–$C_{20}$ linear alkylbenzene sulfonates, alkyl ester sulfonates, $C_6$–$C_{22}$ primary or secondary alkane sulfonates. $C_6$–$C_{24}$ olefin sulfonates, sulfonated polycarboxylic acids, alkyl glycerol sulfonates, fatty acyl glycerol sulfonates, fatty oleyl glycerol sulfonates, and any mixtures thereof.

Essentially any alkoxylated nonionic surfactant or mixture is suitable herein. The ethoxylated and propoxylated nonionic surfactants are preferred.

Preferred alkoxylated surfactants can be selected from the classes of the nonionic condensates of alkyl phenols, nonionic ethoxylated alcohols, nonionic ethoxylated/propoxylated fatty alcohols, nonionic ethoxylate/propoxylate condensates with propylene glycol, and the nonionic ethoxylate condensation products with propylene oxide/ethylene diamine adducts.

The condensation products of aliphatic alcohols with from 1 to 25 moles of alkylene oxide, particularly ethylene oxide and/or propylene oxide, are particularly suitable for use herein. Particularly preferred are the condensation products of straight or branched, primary or secondary alcohols having an alkyl group containing from 6 to 22 carbon atoms with from 2 to 10 moles of ethylene oxide per mole of alcohol.

Polyhydroxy fatty acid amides suitable for use herein are those having the structural formula $R^2CONR^1Z$ wherein: R1 is H, $C_1$–$C_4$ hydrocarbyl, 2-hydroxy ethyl, 2-hydroxy propyl, ethoxy, propoxy, or a mixture thereof, preferable $C_1$–$C_4$ alkyl; and $R_5$ is a $C_5$–$C_{31}$ hydrocarbyl; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl.

Suitable alkylpolysaccharides for use herein are disclosed in U.S. Pat. No. 4,565,647, Llenado, issued Jan. 21, 1986, having a hydrophobic group containing from 6 to 30 carbon atoms and a polysaccharide, e.g., a polyglycoside, hydrophilic group containing from 1.3 to 10 saccharide units. Preferred alkylpolyglycosides have the formula:

$$R^2O(C_nH_{2n}O)t(\text{glycosyl})_x$$

wherein $R^2$ is selected from the group consisting of alkyl, alkylphenyl, hydroxyalkyl, hydroxyalkylphenyl, and mixtures thereof in which the alkyl groups contain from 10 to 18 carbon atoms; n is 2 or 3; v is from 0 to 10, and x is from 1.3 to 8. The glycosyl is preferably derived from glucose.

Suitable amphoteric surfactants for use herein include the amine oxide surfactants and the alkyl amphocarboxylic acids. Suitable amine oxides include those compounds having the formula $R^3(OR^4)_xN^0(R^5)_2$ wherein $R^3$ is selected from an alkyl, hydroxyalkyl, acylamidopropoyl and alkyl phenyl group, or mixtures thereof, containing from 8 to 26 carbon atoms; $R^4$ is an alkylene or hydroxyalkylene group containing from 2 to 3 carbon atoms, or mixtures thereof; x is from 0 to 5, preferably from 0 to 3; and each $R^5$ is an alkyl or hydroxyalkyl group containing from 1 to 3, or a polyethylene oxide group containing from 1 to 3 ethylene oxide groups. Preferred are $C_{10}$–$C_{18}$ alkyl dimethylamine oxide, and $C_{10\text{-}18}$ acylamido alkyl dimethylamine oxide.

Zwitterionic surfactants can also be incorporated into the detergent compositions in accord with the invention. These surfactants can be broadly described as derivatives of secondary and tertiary amines, derivatives of heterocyclic secondary and tertiary amines, or derivatives of quaternary ammonium, quaternary phosphonium or tertiary sulfonium compounds. Betaines such as $C_{12\text{-}18}$ dimethyl-ammonio hexanoate and the $C_{10\text{-}18}$ acylamidopropane (or ethane) dimethyl (or diethyl) betaines and sultaine surfactants are exemplary zwitterionic surfactants for use herein.

Suitable cationic surfactants to be used herein include the quaternary ammonium surfactants. Preferably the quaternary ammonium surfactant is a mono $C_6$–$C_{16}$, preferably $C_6$–$C_{10}$ N-alkyl or alkenyl ammonium surfactants wherein the remaining N positions are substituted by methyl, hydroxyethyl or hydroxypropyl groups. Preferred are also the mono-alkoxylated and bis-alkoxylated amine surfactants.

Cationic ester surfactants such as choline ester surfactants, have for example been disclosed in U.S. Pat. Nos. 4,228,042, 4,239,660 and 4,260,529 are also suitable as are cationic mono-alkoxylated amine surfactants preferably of the general formula I:

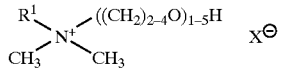

wherein $R^1$ is $C_{10}$–$C_{18}$ hydrocarbyl and mixtures thereof, especially $C_{10}$–$C_{14}$ alkyl, preferably $C_{10}$ and $C_{12}$ allyl, and X is any convenient anion to provide charge balance, preferably chloride or bromide. The levels of the cationic mono-alkoxylated amine surfactants in the detergent compositions of the invention are generally from 0.1% to 20%, preferably from 0.2% to 7%, most preferably from 0.3% to 3.0% by weight.

Cationic bis-alkoxylated amine surfactant such as

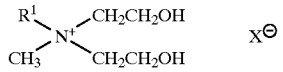

are also useful, wherein $R^1$ is $C_{10}$–$C_{18}$ hydrocarbyl and mixtures thereof, preferably $C_{10}$, $C_{12}$, $C_{14}$ alkyl and mixtures thereof. X is any convenient anion to provide charge balance, preferably chloride.

Bleach Activator

The detergent particles or detergent compositions containing them preferably comprise a bleach activator, preferably comprising an organic peroxyacid bleach precursor. It may be preferred that the composition comprises at least two peroxy acid bleach precursors, preferably at least one hydrophobic peroxyacid bleach precursor and at least one hydrophilic peroxy acid bleach precursor, as defined herein. The production of the organic peroxyacid occurs then by an in situ reaction of the precursor with a source of hydrogen peroxide. The bleach activator may alternatively, or in addition comprise a preformed peroxy acid bleach.

It is preferred that the bleach activator is present in the detergent particle. It may be preferred that the bleach activator is present as a separate, admixed particle. Preferred hydrophobic peroxy acid bleach precursor preferably comprise a compound having an oxy-benzene sulphonate group, preferably NOBS, DOBS, LOBS and/or NACA-OBS. Preferred hydrophilic peroxy acid bleach precursors preferably comprises TAED.

Peroxyacid Bleach Precursor

Peroxyacid bleach precursors are compounds which react with hydrogen peroxide in a perhydrolysis reaction 10 produce a peroxyacid. Generally peroxyacid bleach precursors may be represented as

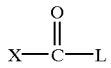

where L is a leaving group and X is essentially any functionality, such that on perhydroloysis the structure of the peroxyacid produced is

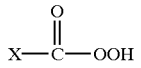

For the purpose of the invention, hydrophobic peroxyacid bleach precursors produce a peroxy acid of the formula above wherein X is a group comprising at least 6 carbon atoms and a hydrophilic peroxyacid bleach precursor produces a peroxyacid bleach of the formula above wherein X is a group comprising 1 to 5 carbon atoms.

The leaving group, hereinafter L group, must be sufficiently reactive for the perhydrolysis reaction to occur within the optimum time frame (e.g., a wash cycle). However, if L is too reactive, this activator will be difficult to stabilize for use in a bleaching composition. Preferred L groups are selected from the group consisting of.

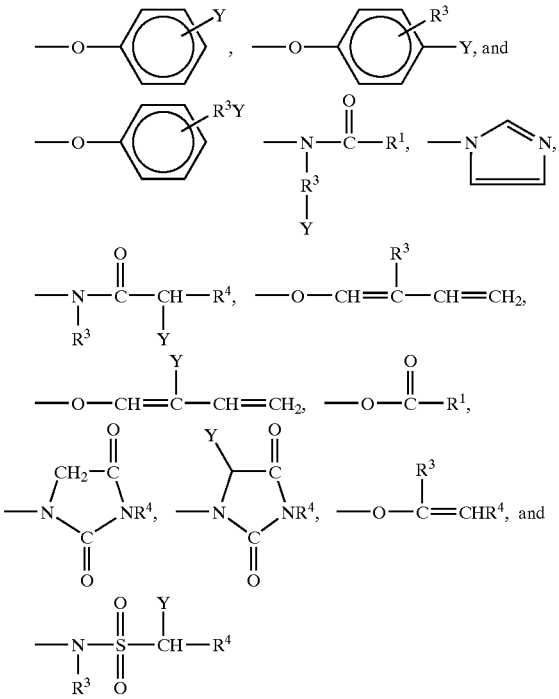

and mixtures thereof, wherein $R^1$ is an alkyl, aryl, or alkaryl group containing from 1 to 14 carbon atoms, $R^3$ is an alkyl chain containing from 1 to 8 carbon atoms. R is H or $R^3$, and Y is H or a solubilizing group. Any of $R^1$, $R^3$ and $R^4$ may be substituted by essentially any functional group including, for example alkyl, hydroxy, alkoxy, halogen, amine, nitrosyl, amide and ammonium or alkyl ammonium groups.

The preferred solubilizing groups are $—SO_3^-M^+$, $—CO_2^-M^+$, $—SO_4^-M^+$, $—N^+(R^3)_4X^-$ and $O<--N(R^3)_3$ and most preferably $—SO_3^-M^+$ and $—CO_2^-M^+$ wherein $R^3$ is an alkyl chain containing from 1 to 4 carbon atoms, M is a cation which provides solubility to the bleach activator and X is an anion which provides solubility to the bleach activator. Preferably, M is an alkali metal, ammonium or substituted ammonium cation, with sodium and potassium being most preferred, and X is a halide, hydroxide, methylsulfate or acetate anion.

Peroxyacid bleach precursor compounds are preferably present in final detergent compositions at a level of from 0.5% to 30% by weight, more preferably from 1% to 15% by weight, most preferably from 1.5% to 10% by weight. The ratio of hydrophilic to hydrophobic bleach precursors, when present, is preferably from 10:1 to 1:10, more preferably from 5; 1 to 1:5 or even from 3:1 to 1:3. Suitable peroxyacid bleach precursor compounds typically contain one or more N- or O-acyl groups, which precursors can be selected from a wide range of classes. Suitable classes include anhydrides, esters, imides, lactams and acylated derivatives of imidazoles and oximes. Examples of useful materials within these classes are disclosed in GB-A-

1586789. Suitable esters are disclosed in GB-A-836988, 864798, 1147871, 2143231 and EP-A-0170386.

Alkyl percarboxylic acid bleach precursors forth percarboxylic acids on perhydrolysis. Preferred precursors of this type provide peracetic acid on perhydrolysis. Preferred alkyl percarboxylic precursor compounds of the imide type include the N-,N,$N^1N^1$ tetra acetylated alkylene diamines wherein the alkylene group contains from 1 to 6 carbon atoms, particularly those compounds in which the alkylene group contains 1.2 and 6 carbon atoms. Tetraacetyl ethylene diamine (TAED) is particularly preferred as hydrophilic peroxy acid bleach precursor. Other preferred alkyl percarboxyiic acid precursors include sodium 3,5,5-tri-methyl hexanoyloxybenzene sulfonate (iso-NOBS), sodium nonanoyloxybenzene sulfonate (NOBS), sodium acetoxybenzene sulfonate (ABS) and pentaacetyl glucose.

Amide substituted alkyl peroxyacid precursor compounds are suitable herein, including those of the following general formulae:

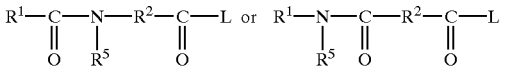

wherein $R^1$ is an aryl or alkaryl group with from about 1 to about 14 carbon atoms, $R^2$ is an alkylene, arylene, and alkarylene group containing from about 1 to 14 carbon atoms, and RS is H or an alkyl aryl, or alkaryl group containing 1 to 10 carbon atoms and L can be essentially any leaving group. $R^1$ preferably contains from about 6 to 12 carbon atoms. $R^2$ preferably contains from about 4 to 8 carbon atoms. $R^1$ may be straight chain or branched alkyl, substituted aryl or alkylaryl containing branching, substitution, or both and may be sourced from either synthetic sources or natural sources including for example, tallow fat. Analogous structural variations are permissible for $R^2$. $R^2$ can include alkyl, aryl, wherein said $R^2$ may also contain halogen, nitrogen, sulphur and other typical substituent groups or organic compounds. $R^5$ is preferably H or methyl. $R^1$ and $R^5$ should not contain more than 18 carbon atoms total. Amide substituted bleach activator compounds of this type are described in EP-A-0170386. It can be preferred that $R^1$ and $R^5$ forms together with the nitrogen and carbon atom a ring structure.

Preferred examples of bleach precursors of this type include amide substituted peroxyacid precursor compounds selected from (6-octanamido-caproyl)oxybenzenesulfonate, (6-decanamido-caproyl)oxybenzene-sulfonate, and the highly preferred (6-nonanamidocaproyl)oxy benzene sulfonate, and mixtures thereof as described in EP-A-0170386.

Perbenzoic acid precursor compounds which provide perbenzoic acid on perhydrolysis benzoxazin organic peroxyacid precursors, as disclosed for example in EP-A-332294 and EP-A-482807 and cationic peroxyacid precursor compounds which produce cationic peroxyacids on perhydrolysis are also suitable. Cationic peroxyacid precursors are described in U.S. Pat. Nos. 4,904,406; 4,751,015; 4,988,451; 4,397,757; 5,269,962; 5,127,852; 5,093,022; 5,106,528: U.K. 1,382,594; EP 475,512, 458,396 and 284,292; and in JP 87-318,332.

Examples of preferred cationic peroxyacid precursors are described in U.S. patent application Nos. 08/298,903, 08/298,650, 08/298,904 and 08/298,906.

Suitable cationic peroxyacid precursors include any of the ammonium or alkyl ammonium substituted alkyl or benzoyl oxybenzene sulfonates, N-acylated caprolactams, and monobenzoyltetraacetyl glucose benzoyl peroxides. Preferred cationic peroxyacid precursors of the N-acylated caprolactam class include the trialkyl ammonium methylene benzoyl caprolactams and the trialkyl ammonium methylene alkyl caprolactams.

The particles or compositions of the present invention may contain, in addition to, or as an alternative to an organic peroxyacid bleach precursor compound, a preformed organic peroxyacid, typically at a level of from 0.1% to 15% by weight, more preferably from 1% to 10% by weight. A preferred class of organic peroxyacid compounds are the amide substituted compounds as described in EP-A0170386. Other organic peroxyacids include diacyl and tetraacylperoxides, especially diperoxydodecanedioc acid, diperoxytetradecanedioc acid and diperoxyhexadecanedioc acid. Mono and diperazelaic acid, mono- and diperbrassylic acid and N-phthaloylaminoperoxicaproic acid are also suitable herein.

Peroxide Source

Inorganic persalts are a preferred source of peroxide. Preferably these salts are present at a level of from 0.01% to 50% by weight, more preferably of from 0.5% to 30% by weight of the particle or composition of the invention. Examples of inorganic perhydrate salts include perborate, percarbonate, perphosphate, persulfate and persilicate salts. The inorganic perhydrate salts are normally the alkali metal salts. The inorganic perhydrate salt may be included as the crystalline solid without additional protection. For certain perhydrate salts however, the preferred executions of such granular compositions utilize a coated form of the material which provides better storage stability for the perhydrate salt in the granular product. Suitable coatings comprise inorganic salts such as alkali metal silicate, carbonate or borate salts or mixtures thereof, or organic materials such as waxes, oils, or fatty soaps. Sodium perborate is a preferred perhydrate salt and can be in the form of the monohydrate of nominal formula $NaBO_2H_2O_2$ or the tetrahydrate $NaBH_2O_2.3H_2O$.

Alkali metal percarbonates, particularly sodium percarbonate are preferred perhydrates herein. Sodium percarbonate is an addition compound having a formula corresponding to $2Na_2CO_3.3H_2O_2$, and is available commercially as a crystalline solid. Potassium peroxymonopersulfate is another inorganic perhydrate salt suitable for use herein.

Chelants

As used herein, chelants refers to detergent ingredients which act to sequester (chelate) heavy metal ions. These components may also have calcium and magnesium chelation capacity, but preferably selectively bind heavy metal ions such as iron, manganese and copper.

Chelants are generally present in the detergent particle or final detergent composition at a level of from 0.005% to 10%, preferably from 0.1% to 5%, more preferably from 0.25% to 7.5% and most preferably from 0.3% to 2% by weight of the compositions or component.

Suitable chelants include organic phosphonates, such as the amino alkylene poly (alkylene phosphonates), alkali metal ethane 1-hydroxy disphosphonates and nitrilo trimethylene phosphonates, preferably, diethylene triamine penta (methylene phosphonate), ethylene diamine tri (methylene phosphonate) hexamethylene diamine tetra (methylene phosphonate) and hydroxyethylene 1,1 diphosphonate, 1,1 hydroxyethane diphosphonic acid and 1,1 hydroxyethane dimethylene phosphonic acid.

Other suitable chelants for use herein include nitrilotriacetic acid and polyaminocarboxylic acids such as ethylenediaminotetracetic acid, ethylenediamine disuccinic acid, ethylenediamine diglutaric acid, 2-hydroxypropylenediamine disuccinic acid or any salts thereof, and iminodiacetic acid derivatives such as 2-hydroxyethyl diacetic acid or glyceryl imino diacetic acid, described in EP-A-317,542 and EP-A-399,133. The iminodiacetic acid-N-2-hydroxypropyl sulfonic acid and aspartic acid N-carboxymethyl N-2-hydroxypropyl-3-sulfonic acid sequestrants described in EP-A-516,102 are also suitable herein. The β-alanine-N,N'-diacetic acid, aspartic acid-N,N'-diacetic acid, aspartic acid-N-monoacetic acid and iminodisuccinic acid sequestrants described in EP-A-509,382 are also suitable. EP-A476.257 describes suitable amino based sequestrants. EP-A-510,331 describes suitable sequestrants derived from collagen, keratin or casein. EP-A-528,859 describes a suitable alkyl iminodiacetic acid sequestrant. Dipicolinic acid and 2-phosphonobutane-1,2,4-tricarboxylic acid are alos suitable. Glycinamide-N,N'-disuccinic acid (GADS), ethylenediamine-N-N'-diglutaric acid (EDDG) and 2-hydroxypropylenediamine-N-N'-disuccinic acid (RPDDS) are also suitable. Especially preferred are diethylenetriamine pentacetic acid, ethylenediamine-N,N'-disuccinic acid (EDDS) and 1,1 hydroxyethane diphosphonic acid or the alkali metal, alkaline earth metal, ammonium, or substituted ammonium salts thereof, or mixtures thereof. In particular the chelating agents comprising a amino or amine group can be bleach-sensitive and are suitable in the compositions of the invention.

Water-Soluble Builder Compound

The component or compositions herein preferably contain a water-soluble builder compound, typically present in detergent compositions at a level of from 1% to 80% by weight, preferably from 10% to 60% by weight, most preferably from 15% to 40% by weight.

The detergent compositions of the invention may comprise phosphate-containing builder material. Preferably present at a level of from 0.5% to 60%, more preferably from 5% to 50%, more preferably from 8% to 40%. The phosphate-containing builder material preferably comprises tetrasodium pyrophosphate or even more preferably anhydrous sodium tripolyphosphate.

Suitable water-soluble builder compounds include the water soluble monomeric polycarboxylates, or their acid forms, homo or copolymeric polycarboxylic acids or their salts in which the polycarboxylic acid comprises at least two carboxylic radicals separated from each other by not more that two carbon atoms, borates, and mixtures of any of the foregoing.

The carboxylate or polycarboxylate builder can be momomeric or oligomeric in type although monomeric polycarboxylates are generally preferred for reasons of cost and performance. Suitable carboxylates containing one carboxy group include the water soluble salts of lactic acid, glycolic acid and ether derivatives thereof. Polycarboxylates containing two carboxy groups include the water-soluble salts of succinic acid, malonic acid, (ethylenedioxy) diacetic acid, maleic acid, diglycolic acid, tartaric acid, tartronic acid and fumaric acid, as well as the ether carboxylates and the sulfinyl carboxylates. Polycarboxylates or their acids containing three carboxy groups include, in particular, water-soluble citrates, aconitrates and citrmconates as well as succinate derivatives such as the carboxymethyloxysuccinates described in British Patent No. 1,379.241, lactoxysuccinates described in British Patent No. 1,389,732, and aminosuccinates described in Netherlands Application 7205873, and the oxypolycarboxylate materials such as 2-oxa-1,1,3-propane tricarboxylates described in British Patent No. 1,387,447. The most preferred polycarboxylic acid containing three carboxy groups is citric acid, preferably present at a level of from 0.1% to 15%, more preferably from 0.5% to 8% by weight.

Polycarboxylates containing four carboxy groups include oxydisuccinates disclosed in British Patent No. 1,261,829, 1,1,2,2-ethane tetracarboxylates, 1,1,3,3-propane tetracarboxylates and 1,1,2,3-propane tetracarboxylates. Polycarboxylates containing sulfo substituents include the sulfosuccinate derivatives disclosed in British Patent Nos. 1,398,421 and 1,398,422 and in U.S. Pat. No. 3,936,448, and the sulfonated pyrolysed citrates described in British Patent No. 1,439,000. Preferred polycarboxylates are hydroxy carboxylates containing up to three carboxy groups per molecule, more particularly citrates.

The parent acids of the monomeric or oligomeric polycarboxylate chelating agents or mixtures thereof with their salts. e.g. citric acid or citrate/citric acid mixtures are also contemplated as useful builder components.

Borate builders and builders containing borate-forming materials that can produce borate under detergent storage or wash conditions are useful water-soluble builders herein.

Suitable examples of water-soluble phosphate builders are the alkali metal tripolyphosphates, sodium, potassium and ammonium pyrophosphate, sodium and potassium and ammonium pyrophosphate, sodium and potassium orthophosphate, sodium polymeta/phosphate in which the degree of polymerization ranges from about 6 to 21, and salts of phytic acid.

Examples of organic polymeric compounds include the water soluble organic homo- or co-polymeric polycarboxylic acids or their salts in which the polycarboxylic acid comprises at least two carboxyl radicals, separated from each other by not more than two carbon atoms. Polymers of the latter type are disclosed in GB-A-1,596,756. Examples of such salts are polyacrylates of $MW_t$ 1000–5000 and their copolymers with maleic anhydride, such copolymers having a molecular weight of from 2000 to 100,000, especially 40,000 to 80,000.

The polyamino compounds are useful herein including those derived from aspartic acid such as those disclosed in EP-A-305282. EP-A-305283 and EP-A-351629.

Partially Soluble or Insoluble Builder Compound

The particles or detergent compositions of the present invention may contain a partially soluble or insoluble builder compound, typically present in detergent compositions at a level of from 0.5% to 60% by weight, preferably from 5% to 50% by weight, most preferably from 8% to 40% weight. Examples of largely water insoluble builders include the sodium aluminosilicates. As mentioned above, it may be preferred in one embodiment of the invention, that only small amounts of alumino silicate builder are present.

Suitable aluminosilicate zeolites have the unit cell formula $Na_z[(AlO_2)_z(SiO_2)y].xH_2O$ wherein z and y are at least 6; the molar ratio of z to y is from 1.0 to 0.5 and x is at least 5, preferably from 7.5 to 276, more preferably from 10 to 264. The aluminosilicate material are in hydrated form and are preferably crystalline, containing from 10% to 28%, more preferably from 18% to 22% water in bound form. The aluminosilicate zeolites can be naturally occurring materials, but are preferably synthetically derived. Synthetic crystalline aluminosilicate ion exchange materials are available under the designations Zeolite A, Zeolite B. Zeolite P. Zeolite X, Zeolite HS and mixtures thereof. Zeolite A has the formula:

$$Na_{12}[AlO_2)_{12}(SiO_2)_{12}].x\ H_2O$$

wherein x is from 20 to 30, especially 27. Zeolite X has the formula $Na_{86}[(AlO_2)_{86}(SiO_2)_{106}]$ 276 $H_2O$.

Another preferred aluminosilicate zeolite is zeolite MAP builder.

The zeolite MAP can be present at a level of from 1% to 80%, more preferably from 15% to 40% by weight. Zeolite MAP is described in EP 384070A (Unilever). It is defined as an alkali metal alumino-silicate of the zeolite P type having a silicon to aluminium ratio not greater than 1.33, preferably within the range from 0.9 to 1.33 and more preferably within the range of from 0.9 to 1.2. Of particular interest is zeolite MAP having a silicon to aluminium ratio not greater than 1.15 and, more particularly, not greater than 1.07.

In a preferred aspect the zeolite MAP detergent builder has a particle size, expressed as a median particle size $d_{50}$ value of from 1.0 to 10.0 micrometres, more preferably from 2.0 to 7.0 micrometres, most preferably from 2.5 to 5.0 micrometres. The $d_{50}$ value indicates that 50% by weight of the particles have a diameter smaller than that figure. The particle size may, in particular be determined by conventional analytical techniques such as microscopic determination using a scanning electron microscope or by means of a laser granulometer, described herein. Other methods of establishing $d_{50}$ values are disclosed in EP 384070A.

Other Detergent Ingredients

A preferred ingredients of the compositions herein are dyes and dyed particles or speckles, which can be bleach-sensitive. The dye as used herein can be a dye stuff or an aqueous or nonaqueous solution of a dye stuff. It may be preferred that the dye is an aqueous solution comprising a dyestuff, at any level to obtain suitable dyeing of the detergent particles or speckles, preferably such that levels of dye solution are obtained up to 2% by weight of the dyed particle, or more preferably up to 0.5% by weight, as described above. The dye may also be mixed with a non-aqueous carrier material, such as non-aquous liquid materials including nonionic surfactants. Optionally, the dye also comprising other ingredients such as organic binder materials, which may also be a non-aqueous liquid.

The dyestuff can be any suitable dyestuff. Specific examples of suitable dyestuffs include E104—food yellow 13 (quinoline yellow), E110—food yellow 3 (sunset yellow FCF), E131—food blue 5 (patent blue V), Ultra Marine blue (trade name), E133—food blue 2 (brilliant blue FCF), E140—natural green 3 (chlorophyll and chlorphyllins), E141 and Pigment green 7 (chlorinated Cu phthalocyanine). Preferred dyestuffs may be Monastral Blue BV paste (trade name) and or Pigmasol Green (trade name).

Another preferred ingredient of the particles or compositions of the invention is a perfume or perfume composition. Any perfume composition can be used herein. The perfumes may also be encapsulated. Preferred perfumes containing at least one component with a low molecular weight volatile component, e.g. having a molecular weight of from 150 to 450 or preferably 350. Preferably, the perfume component comprises an oxygen-containing functional group. Preferred functional groups are aldehyde, ketone, alcohol or ether functional groups or mixtures thereof.

Another highly preferred ingredient useful in the particles or compositions herein is one or more additional enzymes. Preferred additional enzymatic materials include the commercially available lipases, cutinases, amylases, neutral and alkaline proteases, cellulases, endolases, esterases, pectinases, lactases and peroxidases conventionally incorporated into detergent compositions. Suitable enzymes are discussed in U.S. Pat. Nos. 3,519,570 and 3,533,139.

Preferred enzymes are discussed above with respect to the detergent active particulates. The same enzymes are preferred as components of the detergent base powder or as additional detergent ingredients added to the detergent particles of the invention to form a fully formulated detergent.

The detergent particles or compositions herein also preferably contain from about 0.005% to 5% by weight of certain types of hydrophilic optical brighteners, preferably as a detergent active particulate component as mentioned above. Examples are commercially marketed by Ciba Geigy Corporation as Tinopal-UNPA-GX™ and Tinopal-CBS-X™. Others include Tinopal 5BM-GX™, Tinopal-DMS-X™ and Tinopal AMS-GX™ by Ciba Geigy Corporation.

Photo-Bleaching Agent

As described above, photo-bleaching agents are preferred ingredients of the compositions and are preferably present in the form of the detergent active particulates as discussed above. However, they may optionally be present in the detergent base particles or as additional detergent ingredients for addition to the detergent particles of the invention for forming the fully formulated detergnet compositions of the invention.

Organic Polymeric Ingredients

Organic polymeric compounds are preferred additional herein and are preferably present as components of any particulate components where they may act such as to bind the particulate component together. By organic polymeric compound it is meant herein essentially any polymeric organic compound commonly used as dispersants, and anti-redeposition and soil suspension agents in detergent compositions, including any of the high molecular weight organic polymeric compounds described as clay flocculating agents herein, including quaternised ethoxylated (poly) amine clay-soil removal/anti-redeposition agent in accord with the invention.

Organic polymeric compound is typically incorporated in the finished detergent compositions of the invention at a level of from 0.01% to 30%, preferably from 0.1% to 15%, most preferably from 0.5% to 10% by weight of the compositions or component.

Terpolymers containing monomer units selected from maleic acid, acrylic acid, polyaspartic acid and vinyl alcohol, particularly those having an average molecular weight of from 5,000 to 10,000, are also suitable herein.

Other organic polymeric compounds suitable for incorporation in the detergent compositions herein include cellulose derivatives such as methylcellulose, carboxymethylcellulose, hydroxypropylmethylcellulose and hydroxyethylcellulose. Further useful organic polymeric compounds are the polyethylene glycols, particularly those of molecular weight 1000–10000, more particularly 2000 to 8000 and most preferably about 4000. Highly preferred polymeric components herein are cotton and non-cotton soil release polymer according to U.S. Pat. No. 4,968,451, Scheibel et al., and U.S. Pat. No. 5,415,807, Gosselink et al., and in particular according to U.S. application no. 60/051,517.

Another organic compound, which is a preferred clay dispersant/anti-redeposition agent, for use herein, can be the ethoxylated cationic monoamines and diamines of the formula:

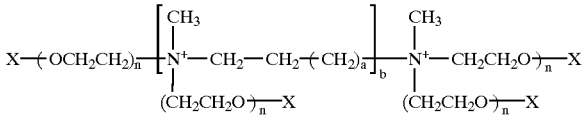

wherein X is a nonionic group selected from the group consisting of H, $C_1$–$C_4$ alkyl or hydroxyalkyl ester or ether groups, and mixtures thereof, a is from 0 to 20, preferably from 0 to 4 (e.g. ethylene, propylene, hexamethylene) b is 1 or 0; for cationic monoamines (b=0), n is at least 16, with a typical range of from 20 to 35; for cationic diamines (b=1), n is at least about 12 with a typical range of from about 12 to about 42.

Other dispersants/anti-redeposition agents for use herein are described in EP-B-011965 and U.S. Pat. No. 4,659,802 and U.S. Pat. No. 4,664,848.

Suds Suppressing System

The suds supressing system is preferably also present in the form of the detergent active particulates as described above. Such components may however be present in the detergent base particles or as additional detergent ingredients for addition to the detergent particles of the invention for formulating a finished detergent composition.

Polymeric dye transfer inhibiting agents may also be present in the detergent particles or compositions of the invention. When present they are generally in amounts from 0.01% to 10%, preferably from 0.05% to 0.5% based on the final detergent compositions and are preferably selected from polyamine N-oxide polymers, copolymers of N-vinylpyrrolidone and N-vinylimidazole, polyvinylpyrrolidonepolymers or combinations thereof, whereby these polymers can be cross-linked polymers.

Polymeric soil release agents, which are described above are also preferably present as detergent active particulates. However they may be present alternatively or in addition, in the detergent base particles or as additional detergent ingredients for addition to the detergent particles of the invention for formulating a finished detergent composition.

Other optional ingredients suitable for inclusion in the compositions of the invention include colours and filler salts, with sodium sulfate being a preferred filler salt.

Highly preferred compositions contain from about 2% to about 10% by weight of an organic acid, preferably citric acid. Also, preferably combined with a carbonate salt, minor amounts (e.g., less than about 20% by weight) of neutralizing agents, buffering agents, phase regulants, hydrotropes, enzyme stabilizing agents, polyacids, suds regulants, opacifiers, anti-oxidants, bactericides and dyes, such as those described in U.S. Pat. No. 4,285,841 to Barrat et al., issued Aug. 25, 1981 (herein incorporated by reference), can be present.

The detergent compositions can include as an additional component a chlotine-based bleach. However, since the detergent compositions of the invention are solid, most liquid chlorine-based bleaching will not be suitable for these detergent compositions and only granular or powder chlorine-based bleaches will be suitable. Alternatively, a chlorine based bleach can be added to the detergent composition by the user at the beginning or during the washing process. The chlorine-based bleach is such that a hypochlorite species is formed in aqueous solution. The hypochlorite ion is chemically represented by the formula OCl.

Those bleaching agents which yield a hypochlorite species in aqueous solution include alkali metal and alkaline earth metal hypochlorites, hypochlorite addition products, chloramines, chlorimines, chloramides, and chlorimides. Specific examples include sodium hypochlorite, Potassium hypochlorite, monobasic calcium hypochlorite, dibasic magnesium hypochlorite, chlorinated trisodium phosphate dodecahydrate, potassium dichloroisocyanurate, sodium dichloroisocyanurate sodium dichloroisocyanurate dihydrate, trichlorocyanuric acid, 1,3-dichloro-5,5-dimethylhydantoin. N-chlorosulfamide, Chloramine T, Dichloramine T, chloramine B and Dichloramine B. A preferred bleaching agent for use in the compositions of the instant invention is sodium hypochlorite, potassium hypochlorite, or a mixture thereof. A preferred chlorine-based bleach can be Triclosan (trade name).

Most of the above-described hypochlorite-yielding bleaching agents are available in solid or concentrated form and are dissolved in water during preparation of the compositions of the instant invention. Some of the above materials are available as aqueous solutions.

Laundry Washing Method

Machine laundry methods herein typically comprise treating soiled laundry with an aqueous wash solution in a washing machine having dissolved or dispensed therein an effective amount of a machine laundry detergent composition in accord with the invention. By an effective amount of the detergent composition it is meant from 10 g to 300 g of product dissolved or dispersed in a wash solution of volume from 5 to 65 liters, as are typical product dosages and wash solution volumes commonly employed in conventional machine laundry methods. Preferred washing machines may be the so-called low-fill machines.

In a preferred use aspect the composition is formulated such that it is suitable for hard-surface cleaning or hand washing. In another preferred aspect the detergent composition is a pre-treatment or soaking composition, to be used to pre-treat or soak soiled and stained fabrics.

EXAMPLES

Abbreviations used in the Examples

In the detergent compositions, the abbreviated component identifications have the following meanings:

| | |
|---|---|
| LAS: | Sodium linear C11–13 alkyl benzene sulfonate |
| TAS: | Sodium tallow alkyl sulfate |
| branched AS: | branched Sodium alkyl sulfate as described in WO99/19454 |
| CxyAS: | Sodium C1x–C1y alkyl sulfate |
| C46SAS: | Sodium C14–C16 secondary (2,3) alkyl sulfate |
| CxyEzS: | Sodium C1x–C1y alkyl sulfate condensed with z moles of ethylene oxide |
| CxyEz: | C1x–C1y predominantly linear primary alcohol condensed with an average of z moles of ethylene oxide |
| QAS: | R2.N+(CH3)2(C2H4OH) with R2 = C12–C14 |
| QAS 1: | R2.N+(CH3)2(C2H4OH) with R2 = C8–C11 |
| APA: | C8–C10 amido propyl dimethyl amine |
| Soap: | Sodium linear alkyl carboxylate derived from an 80/20 mixture of tallow and coconut fatty acids |
| STS: | Sodium toluene sulphonate |
| CFAA: | C12–C14 (coco) alkyl N-methyl glucamide |
| TFAA: | C16–C18 alkyl N-methyl glucamide |
| TPKFA: | C12–C14 topped whole cut fatty acids |

-continued

| | |
|---|---|
| STPP: | Anhydrous sodium tripolyphosphate |
| TSPP: | Tetrasodium pyrophosphate |
| Zeolite A: | Hydrated sodium aluminosilicate of formula Na12(AlO2SiO2)12.27H2O having a primary particle size in the range from 0.1 to 10 micrometers (weight expressed on an anhydrous basis) |
| NaSKS-6: | Crystalline layered silicate of formula d-Na2Si2O5 |
| Citric acid: | Anhydrous citric acid |
| Borate: | Sodium borate |
| Carbonate: | Anhydrous sodium carbonate with a particle size between 200 μm and 900 μm |
| Bicarbonate: | Anhydrous sodium bicarbonate with a particle size distribution between 400 μm and 1200 μm |
| Silicate: | Amorphous sodium silicate (SiO2:Na2O = 2.0:1) |
| Sulfate: | Anhydrous sodium sulfate |
| Mg sulfate: | Anhydrous magnesium sulfate |
| Citrate: | Tri-sodium citrate dihydrate of activity 86.4% with a particle size distribution between 425 μm and 850 μm |
| MA/AA: | Copolymer of 1:4 maleic/acrylic acid, average m. wt. about 70,000 |
| MA/AA (1): | Copolymer of 4:6 maleic/acrylic acid, average m. wt. about 10,000 |
| AA: | Sodium polyacrylate polymer of average molecular weight 4,500 |
| CMC: | Sodium carboxymethyl cellulose |
| Cellulose ether: | Methyl cellulose ether with a degree of polymerization of 650 available from Shin Etsu Chemicals |
| Protease: | Proteolytic enzyme, having 3.3% by weight of active enzyme, sold by NOVO Industries A/S under the tradename Savinase |
| Protease I: | Proteolytic enzyme, having 4% by weight of active enzyme, as described in WO 95/10591, sold by Genencor Int. Inc. |
| Alcalase: | Proteolytic enzyme, having 5.3% by weight of active enzyme, sold by NOVO Industries A/S |
| Cellulase: | Cellulytic enzyme, having 0.23% by weight of active enzyme, sold by NOVO Industries A/S under the tradename Carezyme |
| Amylase: | Amylolytic enzyme, having 1.6% by weight of active enzyme, sold by NOVO Industries A/S under the tradename Termamyl 120T |
| Lipase: | Lipolytic enzyme, having 2.0% by weight of active enzyme, sold by NOVO Industries A/S under the tradename Lipolase |
| Lipase (1): | Lipolytic enzyme, having 2.0% by weight of active enzyme, sold by NOVO Industries A/S under the tradename Lipolase Ultra |
| Endolase: | Endoglucanase enzyme, having 1.5% by weight of active enzyme, sold by NOVO Industries A/S |
| PB4: | Sodium perborate tetrahydrate of nominal formula NaBO2.3H2 O.H2O2— |
| PB1: | Anhydrous sodium perborate bleach of nominal formula NaBO2.H 2O2 |
| Percarbonate: | Sodium percarbonate of nominal formula 2Na2CO3.3H2O2 |
| NOBS: | Nonanoyloxybenzene sulfonate in the form of the sodium salt |
| NAC-OBS: | (6-nonamidocaproyl) oxybenzene sulfonate |
| TAED: | Tetraacctylethylenediamine |
| DTPA: | Diethylene triamine pentaacetic acid |
| DTPMP: | Diethylene triamine penta (methylene phosphonate), marketed by Monsanto under the Tradename Dequest 2060 |
| EDDS: | Ethylenediamine-N,N'-disuccinic acid, (S,S) isomer sodium salt. |
| Photo-activated: | Sulfonated zinc phthlocyanine encapsulated in bleach (1) dextrin soluble polymer |
| Photo-activated: | Sulfonated alumino phthlocyanine encapsulated in bleach (2) dextrin soluble polymer |
| Brightener 1: | Disodium 4,4'-bis(2-sulphostyryl)biphenyl |
| Brightener 2: | Disodium 4,4'-bis(4-anilino-6-morpholino-1,3,5-triazin-2-yl)amino) stilbene-2:2'-disulfonate |
| HEDP: | 1,1-hydroxyethane diphosphonic acid |
| PEGx: | Polyethylene glycol, with a molecular weight of x (typically 4,000) |
| PEO: | Polyethylene oxide, with an average molecular weight of 50,000 |
| TEPAE: | Tetraethylenepentaamine ethoxylate |
| PVI: | Polyvinyl imidosole, with an average molecular weight of 20,000 |

-continued

| | |
|---|---|
| PVP: | Polyvinylpyrolidone polymer, with an average molecular weight of 60,000 |
| PVNO: | Polyvinylpyridine N-oxide polymer, with an average molecular weight of 50,000 |
| PVPVI: | Copolymer of polyvinylpyrolidone and vinylimidazole, with an average molecular weight of 20,000 |
| QEA: | bis((C2H5O)(C2H4O)n)(CH3)—N+—C6H12—N+—(CH3) bis((C2H5O)—(C2H4 O))n, wherein n = from 20 to 30 |
| SRP 1: | Anionically end capped poly esters |
| SRP 2: | Diethoxylated poly (1,2 propylene terephtalate) short block polymer |
| PEI: | Polyethyleneimine with an average molecular weight of 1800 and an average ethoxylation degree of 7 ethyleneoxy residues per nitrogen |
| Silicone antifoam: | Polydimethylsiloxane foam controller with siloxane-oxyalkylene copolymer as dispersing agent with a ratio of said foam controller to said dispersing agent of 10:1 to 100:1 |
| Opacifier: | Water based monostyrene latex mixture, sold by BASF Aktiengesellschaft under the tradename Lytron 621 |
| Wax: | Paraffin wax |
| HMEO: | hexamethylene diamine tetra(ethylene oxide)24 |

The following are examples of the present invention.

Example I

This Example illustrates a process according to this invention which produces uniform free flowing, good dispensing and dissolving detergent particles with uniformity of colour and particle shape. Multiple detergent starting ingredients are dry mixed in an orbital vertical screw mixer of 200 kg batch size, and several batches prepared. This bulk premix is added into a horizontal rotating drum type mixer with internal baffles—a laboratory scale example having batch size 40 kg. A proportion of premix is sampled and added to the mixer. The smaller particles which pose a segregation risk are dry mixed into the mixer.

Binding agent, C45AE7, is sprayed into the mixer using an air atomised nozzle. The product is left to mix for 2 minutes and anti-caking agent (zeolite A) is added into the mixer and mixed for a further 1 minute. The product is run into a storage box. Other detergent additives such as enzymes, percarbonate and dyed carbonate speckles are post-added in a mixing step with other liquid additives such as perfume, to form the final detergent.

| Component | % Weight of Total Feed |
|---|---|
| Dry materials added to the premix | |
| Detergent premix* | 98.48% |
| Photobleach | 0.02% |
| Perfume encaps type 1 | 0.5% |
| Perfume encaps type 2 | 0.2% |
| Binding agent | |
| C45AE7 alcohol ethoxylate | 0.7% |
| Anti-caking agent | |
| Zeolite A | 0.1% |

*= comprising of sodium linear alkyl benzene sulphonate (13.4 wt %), zeolite A (40%), sodium sulphate (23.5%), sodium carbonate (8.4%), magnesium sulphate (0.7 wt %), EDDS (0.4 wt %), MA/AA (2.5 wt %), soap (1.5 wt %), QAS 1(2.0 wt %), HEDP (0.3 wt %), optical brightener (0.5 wt %), water (5.3 wt %), diamine hexamethylene tetra (ethylene oxide) 24 (1.5 wt %).

Example II

This Example also illustrates the process of the invention and incorporates the parameters of Example I. A premix of dry detergent materials is prepared as in example I, of composition as listed below. A proportion of premix is sampled and added to the mixer. Binding agent, C45AE7 mixed with PEG 4000, is sprayed into the mixer using an air atomised nozzle. The premix of increased cohesivity is left to mix for 1 minute. The smaller particles which pose a segregation risk are dry mixed into the mixer. The product is left to mix for 2 minutes and anti-caking agent (zeolite A) is added into the mixer and mixed for a further 1 minute. The product is run into a storage box. Other detergent additives such as enzymes, percarbonate and dyed carbonate speckles are post-added in a mixing step with other liquid additives such as perfume, to form the final detergent.

| Component | % Weight of Total Feed |
|---|---|
| Dry materials added to the premix | |
| Detergent premix* | 98.48% |
| Photobleach | 0.02% |
| Perfume encaps type 1 | 0.5% |
| Perfume encaps type 2 | 0.2% |
| Binding agent | |
| C45AE7 alcohol ethoxylate | 1.0% |
| PEG4000 | 0.5% |
| Anti-caking agent | |
| Zeolite A | 0.2% |

Example III

This Example also illustrates the process of the invention and incorporates the parameters of Example I. A premix of dry detergent materials is prepared as in example 1, of composition as listed below. A proportion of premix is sampled and added to the mixer. Binding agent, C45AE5, is sprayed into the mixer using an air atomised nozzle. The premix of increased cohesivity is left to mix for 1 minute. The smaller particles which pose a segregation risk are dry mixed into the mixer. The product is left to mix for 2 minutes and anti-caking agent (zeolite A) is added into the mixer and mixed for a further 15 seconds. The product is run into a storage box. Other detergent additives such as enzymes, percarbonate and dyed carbonate speckles are post-added in a mixing step with other liquid additives such as perfume, to form the final detergent.

| Component | % Weight of Total Feed |
|---|---|
| Dry materials added to the premix | |
| Detergent premix* | 97.78% |
| Photobleach | 0.02% |
| Perfume encaps type 1 | 0.4% |
| Perfume encaps type 2 | 0.1% |
| Binding agent | |
| C45AE5 alcohol ethoxylate | 1.5% |
| Anti-caking agent | |
| Zeolite A | 0.2% |

Example IV

This Example also illustrates the process of the invention and incorporates the parameters of Example I. A premix of dry detergent materials is prepared as in example 1, of composition as listed below. A proportion of premix is sampled and added to the mixer. Bonding agent, C45AE7, is sprayed into the mixer using an air atomised nozzle. The premix of increased cohesivity is left to mix for 1 minute. The smaller particles which pose a segregation risk are dry mixed into the mixer. A further spray-on of bonding agent is applied to fix the small particles firmly to the surface of the larger host particles. The product is left to mix for 2 minutes and anti-caking agent (zeolite A) is added into the mixer and mixed for a further 1 minute. The product is run into a storage box. Other detergent additives such as enzymes, percarbonate and dyed carbonate speckles are post-added in a mixing step with other liquid additives such as perfume, to form the final detergent.

| Component | % Weight of Total Feed |
|---|---|
| Dry materials added to the premix | |
| Detergent premix* | 98.2% |
| Photobleach | 0.02% |
| Perfume encaps type 1 | 0.5% |
| Perfume encaps type 2 | 0.2% |
| Binding fluid | |
| C45AE7 alcohol ethoxylate | 1.0% |
| Anti-caking agent | |
| Zeolite A | 0.08% |

Example V

This Example also illustrates the process of the invention and incorporates the parameters of Example I. A premix of dry detergent materials is prepared as in example 1, of composition as listed below. A proportion of premix is sampled and added to the mixer.

The fine segregatable particles are dispersed into a carrier fluid such as C45AE7 in a tank, using low shear agitation, mixed for 10 minutes. The suspension of fine particles in fluid is pumped to a spray nozzle and atomised onto the premix particles in the mixer.

The product is left to mix for 2 minutes and anti-caking agent (zeolite A) is added into the mixer and mixed for a further 1 minute. The product is run into a storage box. Other detergent additives such as enzymes, percarbonate and dyed carbonate speckles are post-added in a mixing step with other liquid additives such as perfume, to form the final detergent.

| Component | % Weight of Total Feed |
|---|---|
| Dry materials added to the premix | |
| Detergent premix* | 96.48% |
| Photobleach | 0.02% |
| Binding fluid | |
| C45AE7 alcohol ethoxylate | 3.0% |
| Anti-caking agent | |
| Zeolite A | 0.5% |

Further example compositions

In the following examples all levels are quoted as % by weight of the full finished detergent composition:

TABLE

The following compositions are in accordance with the invention.

| | A | B | C | D | E | F | Particle size (median, μm) | Span | ΔE Colour difference of raw material compared to finished composition | Sphericity (Mean) |
|---|---|---|---|---|---|---|---|---|---|---|
| 1. Spray-dried Granules | | | | | | | 450 μm | 1.8 | 2.4 | 1.9 |
| LAS | 4.0 | 5.0 | 11.0 | 7.0 | 4.0 | 5.0 | | | | |
| TAS | — | — | — | — | — | 1.0 | | | | |
| $C_{45}$AS | 1.0 | — | — | — | 1.0 | — | | | | |
| C16–C17 branched AS | 2.0 | 3.0 | — | — | 2.0 | — | | | | |
| DTPA, HEDP and/or EDDS | 0.5 | 0.6 | 0.5 | 0.7 | 1.0 | 0.5 | | | | |
| MgSO4 | 0.5 | 0.4 | 0.5 | 0.4 | 0.5 | 0.5 | | | | |
| Sodium carbonate | 10.0 | 7.0 | 8.0 | 8.0 | 3.0 | 10.0 | | | | |
| Sodium sulphate | 5.0 | 2.0 | 2.0 | 5.0 | 3.0 | 3.0 | | | | |
| Zeolite A | 18.0 | 20.0 | 18.0 | 10.0 | 20.0 | 17.0 | | | | |
| SKS-6 | — | — | — | — | — | — | | | | |
| MA/AA or AA | 1.0 | 1.5 | 1.0 | 0.6 | 1.0 | 0.6 | | | | |
| QAS 1 | 1.0 | 0.5 | 1.0 | — | 0.8 | 1.0 | | | | |
| Brightener | 0.1 | 0.05 | 0.05 | 0.06 | 0.05 | 0.05 | | | | |
| HMEO | 0.5 | 0.5 | 1.0 | 0.5 | 1.0 | 1.0 | | | | |
| Soap | — | 1.5 | 1.0 | 1.5 | — | 1.5 | | | | |
| 2. Components within the premix | | | | | | | | | | |
| Spray dried granules (1) | 50.0 | 50.0 | 48.0 | 40.0 | 40.0 | 50.0 | | | | |
| Nonionic AE7/AE5 | — | — | 5.0 | — | — | — | | | | |
| Sodium carbonate | 2.0 | 8.0 | — | 4.0 | 6.0 | 5.0 | 200 μm | 1.5 | 4.0 | 1.5 |
| Sodium sulphate | — | — | — | — | 2.0 | 1.0 | 350 μm | 1.6 | 3.5 | 1.5 |
| QAS 1 agglomerate | — | — | — | 2.0 | — | 1.0 | 500 μm | 2.7 | 5.0 | 2.1 |
| Nonionic agglomerate | | | | 10.0 | — | — | 500 μm | 1.9 | 8.3 | 1.8 |
| SKS-6/LAS agglomerate | — | — | — | 12.0 | — | — | 350 μm | 1.8 | 14.6 | 1.9 |
| Silicone antifoam agglomerate | 2.5 | 2.5 | 2.0 | 0.5 | — | 2.5 | 500 μm | 2.0 | 14.3 | 1.5 |
| SRP 1 | 0.5 | — | — | — | 0.5 | 0.3 | 500 μm | 2.0 | 10.4 | 2.0 |
| TAED agglomerate | 2.5 | 2.5 | 3.0 | — | — | — | 550 μm | 1.5 | 11.4 | 1.6 |
| SKS-6 powder | 3.5 | 3.5 | 9.0 | — | 3.5 | 5.0 | 60 μm | 1.9 | 6.0 | 1.7 |
| TAED powder | — | — | — | — | 1.5 | 2.0 | 80 μm | 1.7 | 9.5 | 1.6 |
| 3. Premix binder | | | | | | | | | | |
| applied to the premix (2) | | | | | | | | | | |

TABLE-continued

The following compositions are in accordance with the invention.

| | A | B | C | D | E | F | Particle size (median, μm) | Span | ΔE Colour difference of raw material compared to finished composition | Sphericity (Mean) |
|---|---|---|---|---|---|---|---|---|---|---|
| PEG 4000 | 5.0 | | | | | | | | | |
| PEG 1500 | | | | 6.0 | | | | | | |
| AS, LAS, MBAS | | | | | 5.0 | 6.0 | | | | |
| Water as binder (removed on drying) | | 10.0 | 15.0 | | | | | | | |
| Other additives post-added to make the final detergent formulation: | | | | | | | | | | |
| 4. Spray-on materials | | | | | | | | | | |
| Perfume | 0.4 | 0.2 | 0.4 | 0.4 | 0.5 | 0.3 | | | | |
| 5. Dry-added materials | | | | | | | | | | |
| Premix (2) | 70.0 | 65.0 | 55.0 | 65.0 | 70.0 | 60.0 | | | | |
| Enzymes (protease, lipolase, amylase, cellulase) | 2.0 | 1.5 | 1.0 | 1.3 | 1.2 | 1.5 | | | | |
| NACAOBS | 3.0 | 2.5 | 3.0 | 3.5 | 3.5 | 2.5 | | | | |
| Sodium percarbonate | 13.0 | 10.0 | 10.0 | 12.0 | 12.0 | 10.0 | | | | |
| Photobleach | 0.02 | 0.02 | 0.02 | 0.02 | 0.02 | 0.02 | | | | |
| Perfume encapsulates | 0.7 | 0.5 | 0.6 | 0.8 | 0.9 | 0.4 | | | | |
| Citric add | 6.0 | 4.0 | 2.0 | 4.0 | 6.5 | 5.0 | | | | |
| Sodium carbonate speckle | 1.0 | 1.0 | 1.0 | 0.5 | 1.5 | 1.5 | | | | |
| Zeolite A | 0.1 | — | — | 0.3 | — | — | | | | |
| TAED agglomerate | — | — | — | 3.0 | — | | | | | |
| Silicone antifoam agglomerate | — | — | — | — | 3.0 | — | | | | |
| 6. Coating | | | | | | | | | | |
| Applied to premix (2) | | | | | | | | | | |
| Burkeite (applied in 30 wt % aqueous solution) | 4.0 | 5.0 | 8.0 | — | 5.0 | — | | | | |
| Brightener 15 | 0.1 | 0.1 | — | — | — | — | | | | |
| Fillers up to 100% | | | | | | | | | | |
| Finished product | | | | | | | | | | |
| Median particle size | 600 μm | 600 μm | 600 μm | 800 μm | 800 μm | 600 μm | | | | |
| Span (geometric standard deviation) | 1.4 | 1.2 | 1.4 | 1.2 | 1.4 | 1.6 | | | | |

TABLE-continued

The following compositions are in accordance with the invention.

| | A | B | C | D | E | F | Particle size (median, μm) | Span | ΔE Colour difference of raw material compared to finished composition | Sphericity (Mean) |
|---|---|---|---|---|---|---|---|---|---|---|
| Roundness (mean) | 1.30 | 1.20 | 1.35 | 1.40 | 1.45 | 1.40 | | | | |
| Whiteness W = L-3b | 98.0 | 96.5 | 98.5 | 92.0 | 97.0 | 101.5 | | | | |

Having thus described the invention in detail, it will be obvious to those skilled in the art that various changes may be made without departing from the scope of the invention and the invention is not to be considered limited to what is described in the specification.

What is claimed is:

1. A method for making a detergent composition comprising detergent particles, said composition having detergent active particulates disposed uniformly therethrough, said method comprising the steps of:

selecting detergent base particles having a geometric mean particle size from 500–2500 microns;

and, adhering active particulates having a geometric mean particle diameter below 200 μm to the detergent base particles in a moderate to low shear mixer in which a first stream of said detergent base particles is added to said mixer, a second stream of said detergent active particulates is added to the mixer and binder also present in the mixer effects adhesion of said detergent active particulates to said base detergent particles, wherein said detergent active particulates have a geometric mean particle diameter no greater than 20% of the geometric mean particle size of said detergent base particles and said detergent active particulates comprise a detergent active selected form the group consisting of perfumes, and photobleaches.

2. A method according to claim 1 in which the binder is added by a third stream directly into the mixer.

3. A method according to claim 1 in which a binder is added to the detergent base particles or the detergent active particulate prior to their addition to the mixer.

4. A method according to claim 1 in which the geometric mean particle diameter of the detergent active particulates is no greater than 10% of the geometric mean particle size of the detergent base particles.

5. A method according to claim 4 in which the geometric mean particle diameter of the detergent active particulates is no greater than 5% of the geometric mean particle size of the detergent base particles.

6. A method according to claim 1 in which the geometric mean particle diameter of the detergent active particulates is no greater than 150 microns.

* * * * *